US005422210A

United States Patent [19]

Maruyama et al.

[11] Patent Number: 5,422,210

[45] Date of Patent: Jun. 6, 1995

[54] ELECTROPHOTOGRAPHIC PHOTOSENSITIVE MEMBER AND ELECTROPHOTOGRAPHIC APPARATUS, DEVICE UNIT AND FACSIMILE MACHINE USING THE SAME

[75] Inventors: Akio Maruyama, Tokyo; Toshiro Kikuchi, Yokohama; Shoji Amamiya, Kawasaki; Shin Nagahara, Tokyo; Katsumi Aoki, Yokohama, all of Japan

[73] Assignee: Canon Kabushiki Kaisha, Tokyo, Japan

[21] Appl. No.: 968,465

[22] Filed: Oct. 29, 1992

Related U.S. Application Data

[63] Continuation-in-part of Ser. No. 852,720, Mar. 17, 1992, abandoned.

[30] Foreign Application Priority Data

| | | | |
|---|---|---|---|
| Mar. 18, 1991 | [JP] | Japan | 4-062306 |
| Mar. 18, 1991 | [JP] | Japan | 3-077290 |
| Mar. 18, 1991 | [JP] | Japan | 3-077291 |
| Mar. 18, 1991 | [JP] | Japan | 3-077292 |

[51] Int. Cl.[6] ..... G03G 5/14

[52] U.S. Cl. ..... 430/59; 430/66

[58] Field of Search ..... 430/58, 59, 66, 67, 430/59

[56] References Cited

U.S. PATENT DOCUMENTS

| | | | |
|---|---|---|---|
| 4,362,799 | 12/1982 | Kondo et al. | 430/67 |
| 4,921,770 | 5/1990 | Murayama et al. | 430/76 |
| 4,931,371 | 6/1990 | Matsumoto et al. | 430/59 |
| 4,988,596 | 1/1991 | Ueda | 430/59 |
| 5,008,172 | 4/1991 | Rokutanzono | 430/66 |
| 5,114,814 | 5/1992 | Sakoh et al. | 430/46 |

FOREIGN PATENT DOCUMENTS

| | | |
|---|---|---|
| 425224 | 5/1991 | European Pat. Off. . |
| 443626 | 8/1991 | European Pat. Off. . |
| 460558 | 12/1991 | European Pat. Off. . |
| 464749 | 1/1992 | European Pat. Off. . |
| 2917151 | 11/1979 | Germany . |
| 53-103741 | 9/1978 | Japan . |
| 56-42863 | 4/1981 | Japan . |
| 57-30843 | 2/1982 | Japan . |
| 61-5253 | 1/1986 | Japan . |
| 1-178972 | 7/1989 | Japan . |

*Primary Examiner*—John Goodrow

*Attorney, Agent, or Firm*—Fitzpatrick, Cella, Harper & Scinto

[57] ABSTRACT

A electrophotographic photosensitive member and an electrophotographic apparatus, a device unit and a facsimile machine using an electrophotographic photosensitive member which comprises a conductive support, a photosensitive layer and a protective layer, the protective layer containing resin formed by hardening a light-setting type acrylic monomer, and the photosensitive layer containing at least one compound selected from the group consisting of (A), (B) and (C) below:

(A) styryl compounds having a structure expressed by the following formula (1) and a melting point not higher than 135° C.;

(1)

wherein $Ar^1$ and $Ar^2$ are aromatic ring groups, $Ar^3$ is a bivalent aromatic ring group or a bivalent heterocyclic group, $R^1$ is an alkyl group or an aromatic ring group, $R^2$ is a hydrogen atom, an alkyl group or an aromatic ring group, and $n_1$ is 1 or 2, $R^1$ and $R^2$ possibly linking to form a ring when $n_1=1$;

(B) triarylamine compounds having a structure expressed by the following formula (2) and a melting point not higher than 150° C.;

(2)

(Abstract continued on next page.)

wherein $Ar^4$, $Ar^5$ and $Ar^6$ are each an aromatic ring group or a heterocyclic group:

(C) hydrazone compounds having a structure expressed by the following formula (3) and a melting point not higher than 155° C.;

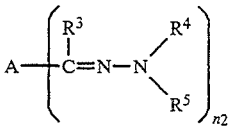

(3)

wherein $R^3$ is a hydrogen atom or an alkyl group, $R^4$ and $R^5$ are alkyl groups, aralkyl groups or aromatic ring groups, $n_2$ is 1 or 2, A is an aromatic ring group, a heterocyclic group or —CH=C($R^6$)$R^7$ ($R^6$ and $R^7$ are hydrogen atoms, aromatic ring groups or heterocyclic groups, but will never be hydrogen atoms at the same time). The photosensitive member suppresses the occurrence of cracks during forming of the protective layer, has high durability, and is free from any image defects.

26 Claims, 1 Drawing Sheet

ELECTROPHOTOGRAPHIC PHOTOSENSITIVE MEMBER AND ELECTROPHOTOGRAPHIC APPARATUS, DEVICE UNIT AND FACSIMILE MACHINE USING THE SAME

This application is a continuation-in-part of application Ser. No. 07/852,720 filed Mar. 17, 1992, now abandoned.

BACKGROUND OF THE INVENTION

1. Field of the Invention

The present invention relates to an electrophotographic photosensitive member, and more particularly to an electrophotographic photosensitive member comprised of a protective layer containing particular resin and a photosensitive layer containing a particular compound. The present invention also relates to an electrophotographic apparatus, a device unit and a facsimile machine using such an electrophotographic photosensitive member.

2. Related Background Art

An electrophotographic photosensitive member is of course required to have sensitivity, electric characteristics and optical characteristics necessary for the electrophotographic process. In particular, a photosensitive member being used over again is brought into a condition that electrical and mechanical external forces caused during the steps of corona charging, image exposure, toner development, transfer to paper and cleaning are directly and repeatedly applied to the surface of the photosensitive member and, therefore, is required to withstand those external forces. Specifically, a photosensitive member must have durability against abrasion and/or flaws caused on its surface due to slide contact with other components during the steps of transfer and cleaning, deterioration of the photosensitive member and potential characteristics due to ozone generated during the step of corona charging, etc. In view of another problem that toner tends to deposit on the surface of a photosensitive member due to the repeated steps of toner development and cleaning, a good cleaning ability is also required.

To satisfy the above requirements imposed on photosensitive members, it has been attempted to provide a surface protective layer, containing resin as a main ingredient, over a photosensitive layer. For instance, Japanese Patent Application Laid-Open No. 56-42863 and No. 53-103741 propose use of a protective layer containing setting type resin as a main ingredient to improve hardness and wear resistance.

However, in the case of using such setting type resin as a surface protective layer, particularly where an underlying photosensitive layer is an organic photosensitive layer also containing resin as a main ingredient, it has been experienced that contraction produced upon hardening of the setting type resin may cause cracks in the protective layer and/or the photosensitive layer, thus giving rise to defects in an image reproduced.

Further, obtaining a higher quality image requires not only that the protective layer of the photosensitive member has such characteristics as high hardness and superior wear resistance, but also that the protective layer itself has proper resistance. When the resistance of the protective layer is too high, there occurs an increase in the so-called residual potential, i.e., accumulation of electric charges in the protective layer through the repeated electrophotographic process of charging and exposure. This results in unstable image quality because the potential is not kept steady during repeated use of the photosensitive member. Conversely, when the resistance is too low, an electrostatic latent image tends to drift in the planer direction, which gives rise to the problem such as blur or feathering. For the purpose of solving those problems, it is proposed in, for example, Japanese Patent Application Laid-Open No. 57-30843 to control resistance of a protective layer by adding a metal oxide in the form of electroconductive fine particles to the protective layer.

Even in the case of using that proposed protective layer, however, it has been found that the protective layer and/or the photosensitive layer may crack when setting type resin is used as resin for the protective layer and an organic photosensitive layer is used as the photosensitive layer.

In view of a recent increasing demand for higher image quality and higher durability, studies and researches have been made to develop an electrophotographic photosensitive member which is more highly durable and can stably present an image of higher quality.

SUMMARY OF THE INVENTION

An object of the present invention is to provide an electrophotographic photosensitive member which can suppress the occurrence of cracks in the photosensitive member during forming of a protective layer, has high durability, and is free from any image defects.

Another object of the present invention is to provide an electrophotographic photosensitive member which can keep high image quality without accumulating a residual potential through the electrophotographic process repeated.

Still another object of the present invention is to provide an electrophotographic apparatus, a device unit and a facsimile machine using such as electrophotographic photosensitive member.

Specifically, the present invention resides in an electrophotographic photosensitive member comprising a conductive support, a photosensitive layer and a protective layer, the protective layer containing resin formed by hardening a light-setting type acrylic monomer, and the photosensitive layer containing at least one compound selected from the group consisting of (A), (B) and (C) below:

(A) styryl compounds having a structure expressed by the following formula (1) and a melting point not higher than 135° C.;

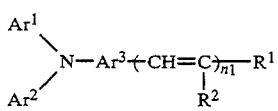

(1)

wherein $Ar^1$ and $Ar^2$ are aromatic ring groups, $Ar^3$ is a bivalent aromatic ring group or a bivalent heterocyclic group, $R^1$ is an alkyl group or an aromatic ring group, $R^2$ is a hydrogen atom, an alkyl group or an aromatic ring group, and $n_1$ is 1 or 2, $R^1$ and $R^2$ may be joined together to form a ring when $n_1=1$;

(B) triarylamine compounds having a structure expressed by the following formula (2) and a melting point not higher than 150° C.;

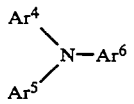

(2)

wherein $Ar^4$ $Ar^5$ and $Ar^6$ are each an aromatic ring group or a heterocyclic group:

(C) hydrazone compounds having a structure expressed by the following formula (3) and a melting point not higher than 155° C.;

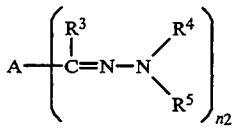

(3)

wherein $R^3$ is a hydrogen atom or an alkyl group, $R^4$ and $R^5$ are alkyl groups, aralkyl groups or aromatic ring groups, $n_2$ is 1 or 2, A is an aromatic ring group, a heterocyclic group or —CH=C($R^6$)$R^7$ ($R^6$ and $R^7$ are hydrogen atoms, aromatic ring groups or heterocyclic groups, provided that $R^6$ and $R^7$ are not both hydrogen atoms at the same time).

Also, the present invention resides in an electrophotographic apparatus, a device unit and a facsimile machine using the above electrophotographic photosensitive member.

DETAILED DESCRIPTION OF THE INVENTION AND EMBODIMENTS

Figure 1:
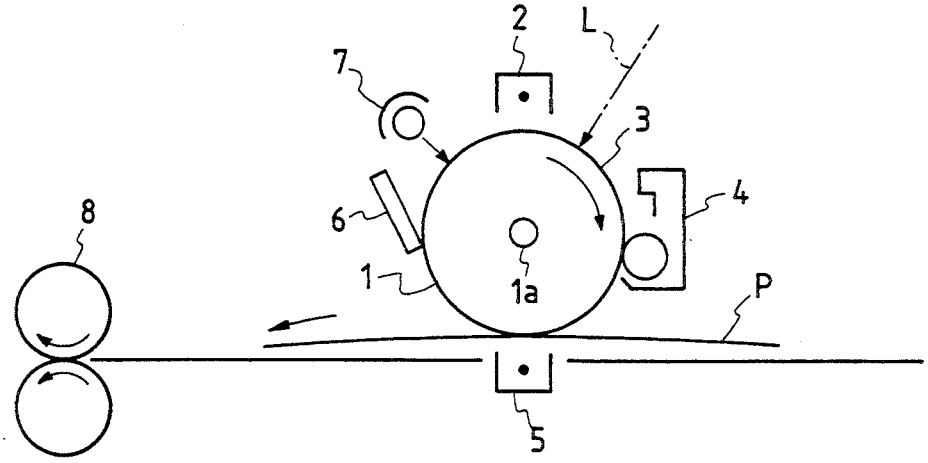
FIG. 1 shows an example of schematic arrangement of an electrophotographic apparatus using an electrophotographic photosensitive member of the present invention.

A protective layer included in an electrophotographic photosensitive member of the present invention contains resin obtained by hardening a light-setting type acrylic monomer (hereinafter referred to as an acrylic monomer of the present invention).

As an attempt of using setting type acrylic resin is a protective layer of a photosensitive member, use of heat-setting type acrylic resin is exemplified in Japanese Patent Application Laid-Open No. 61-5253 and No. 1-178972, for instance. However, when such heat-setting type acrylic resin is coated on an organic photosensitive layer and hardened under heating, a hardener, an acrylic monomer, an acrylic olygomer and so forth are forced to migrate into the photosensitive layer during the temperature increasing process, and react with charge transporting materials and/or charge generating materials to cause drawbacks such as a reduction in the sensitivity and an increase in the residual potential.

As a result of conducting various studies in view of the above, the inventors have found that those drawbacks can be solved by using the light-setting type acrylic monomer.

Further, the resin obtained from the light-setting type acrylic monomer has sufficient hardness which is one of important characteristics required for the protective layer.

Examples of the acrylic monomer of the present invention are enumerated below, but not in a limiting sense.

| Illustrated Compound No. | Structural Formula | Number of Functional Groups |
|---|---|---|
| (1) | 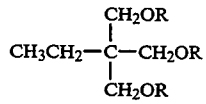 | 3 |
| (2) | 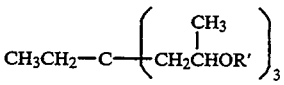 | 3 |
| (3) | 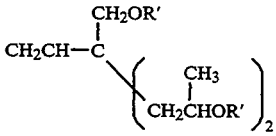 | 3 |
| (4) | 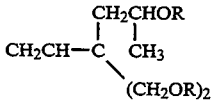 | 3 |
| (5) | 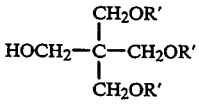 | 3 |
| (6) | 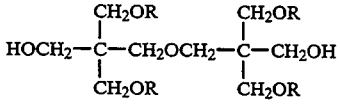 | 4 |

-continued
| Illustrated Compound No. | Structural Formula | Number of Functional Groups |
|---|---|---|
| (7) | $ROCH_2-C(CH_2OR)_2-CH_2OCH_2-C(CH_2OR)_2-CH_2OR$ | 6 |
| (8) | $(R'OCH_2)_3C-CH_2OCH_2-C(CH_2OR')(R'OC_5H_{10}-C(=O))_2$ | 6 |
| (9) | 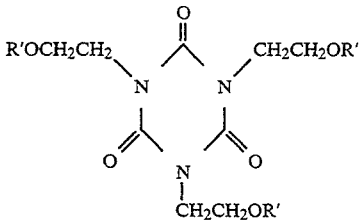 | 3 |
| (10) | $CH_3CH_2C(CH_2OC_3H_6OR)_3$ | 3 |
| (11) | 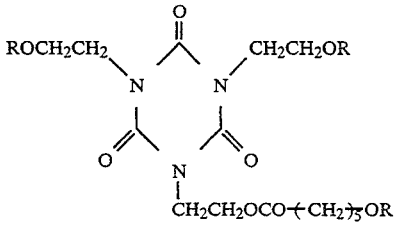 | 3 |
| (12) | $(ROCH_2)_3C-O-C(CH_2OR)_3$ | 6 |
| (13) | $(ROCH_2)_3C-CH_2OCH_2-C(H)(CH_2OR)_2$ | 5 |
| (14) | $(ROCH_2)_3C-CH_2OCH_2-C(CH_3)(CH_2OR)_2$ | 5 |
| (15) | $(ROCH_2)_3C-CH_2OCH_2-C(CH_2OH)(CH_2OR)_2$ | 5 |
| (16) | $(R'OCH_2)_3C-CH_2OCH_2-C(CH_2OR')(CH_2OH)_2$ | 4 |
| (17) | $(ROCH_2)_3C-O-C(CH_2OH)(CH_2OR)_2$ | 5 |
| (18) | 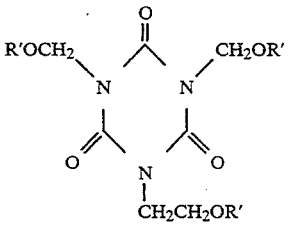 | 3 |
| (19) | $CH_3CH_2-C(CH_2CH_2OR)_3$ | 3 |
| (20) | $HOCH_2-C(CH_2O-C(=O)CH_2CH_2CH_2CH_2CH_2OR)_3$ | 3 |

-continued

| Illustrated Compound No. | Structural Formula | Number of Functional Groups |
|---|---|---|
| (21) | 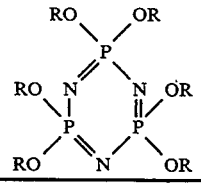 | 6 |

In the above formula, R and R' are given by the following formulae:

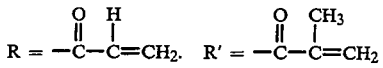

The resin used in the present invention may be obtained from two or more light-setting type acrylic monomers or may be mixed with other types of resins such as polyester, polycarbonate, polyurethane, acrylic resin, epoxy resin, silicone resin, alkyd resin, and copolymer of vinyl chloride and vinyl acetate.

When hardening the acrylic monomer of the present invention, an optical starting agent (or photo-initiator) is used. The amount of addition of the optical starting agent is preferably in a range of 0.1 to 40 wt. % based on the total weight of the acrylic monomer, more preferably in a range of 0.5 to 20 wt. %. Examples of the optical starting agent used are enumerated below, but not in a limiting sense.

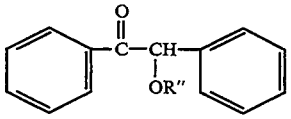

R'' = isopropyl or isobutyl

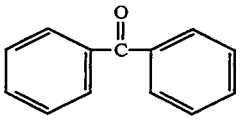

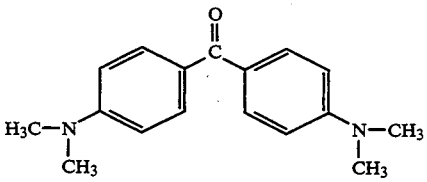

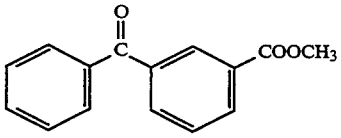

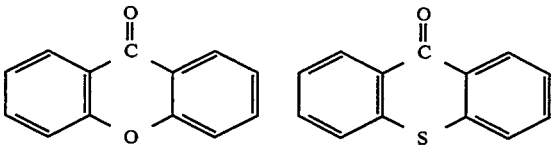

-continued

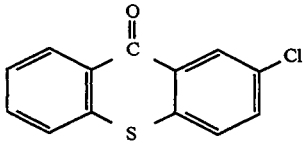

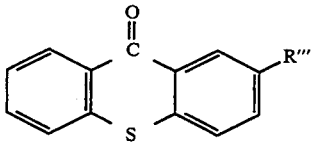

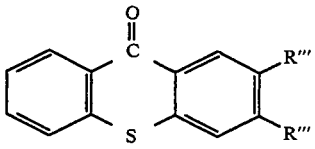

R'' = isopropyl or methyl or ethyl

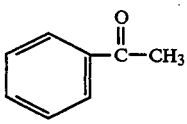

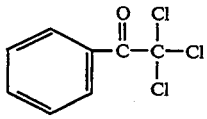

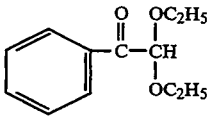

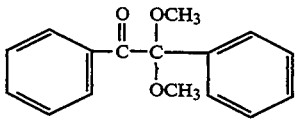

From the standpoint of controlling resistance of the protective layer, the protective layer in the present invention preferably contains conductive particles, e.g., metal oxide particles, in a dispersed state.

Examples of such particles of conductive metal oxide are particles of zinc oxide, titanium oxide, tin oxide, antimony oxide, indium oxide, bismuth oxide, indium oxide doped with tin, tin oxide doped with antimony, and zirconium oxide. These metal oxides may be used solely or in the mixed form consisting of two or more kinds. Two or more kinds of metal oxides may be mixed with each other into the form of a solid solution or fusion. The content of metal oxide particles in the present invention is preferably in a range of 5 to 90 wt. % based on the total weight of the protective layer, more preferably in a range of 10 to 90 wt. %. If the content of metal oxide particles is less than 5 wt. %, a resistance value of the protective layer might be too high. If it is greater than 90 wt. %, the resistance value tends to be lower than a level required for the surface layer of the photosensitive member, thus resulting in a reduced charging ability and the cause of pin holes.

When dispersing conductive particles into the protective layer, in particle size is preferably smaller than the wavelength of incident light for the purpose of preventing the incident light from being acattered by the dispersed particles. In general, the number-average particle size is preferably less than 0.3 μm. The smaller the particle size of the dispersed particles, the more the dispersed particles will become hard to disperse. In the present invention, therefore, it is preferable to use the light-setting type acrylic monomer having three or more functional groups per molecule, or the light-setting type acrylic monomer having the number of functional groups not less than 0.004 mol/g per unit weight. The larger number of functional groups per molecule is also preferable in point of hardness because the resin structure is more likely to become three-dimensional.

Additionally, in order to further improve dispersibility, adhesion and resistance against environments, the protective layer in the present invention may be added with any of various coupling agent and/or anti-oxidizing agents.

The thickness of the protective layer in the present invention is preferably in a range of 0.1 to 10 μm, more preferably in a range of 0.5 to 7 μm.

The protective layer can be coated by any of such methods as spray coating, beam coating and dip coating.

As mentioned before, where a protective layer using setting-type resin is provided on an organic photosensitive layer, the protective layer and the photosensitive layer have a tendency to easily crack.

Although the detailed mechanism as to how the photosensitive member cracks upon coating and hardening of the protective layer have not been clarified yet, it is easily presumed that film contraction caused during hardening of the protective layer takes a part in the mechanism, and thought that such cracks are also attributable to the structure of the setting type monomer for the resin used in the protective layer. Specifically, it is believed that the more the number of functional groups in the monomer per molecule, i.e., the more the number of functional groups in the monomer per unit weight, the more frequent cracks will be likely to occur. As mentioned above, however, the light setting type acrylic monomer as a monomer for resin used in the protective layer has higher hardness and is improved in such characteristics as resistance against scraping and flaws, with an increase in the number of functional groups in the acrylic monomer per molecule or unit weight. Moreover, where conductive particles are dispersed into the protective layer, dispersibility is improved as the number of functional groups in the light-setting type acrylic monomer increases. Accordingly, the advantage obtained by using the light-setting type acrylic monomer having the larger number of functional groups as a monomer for resin used in the protective layer is remarkable, and the invention of a technique of forming a protective layer on an organic photosensitive layer by the use of such resin without causing cracks is very valuable.

In view of the above, the inventors have conducted various studies and researches and, as a result, accomplished the present invention based on the finding that by providing a protective layer of the present invention on a photosensitive layer containing a charge transporting material which has the particular structure and melting point, a photosensitive member can be prevented from cracking.

More specifically, the present invention resides in an electrophotographic photosensitive member comprising a conductive support, a photosensitive layer and a protective layer, the protective layer containing resin formed by hardening a light-setting type acrylic monomer, and the photosensitive layer containing at least one compound selected from the group consisting of (A), (B) and (C) below:

(A) styryl compounds having a structure expressed by the following formula (1) and a melting point not higher than 135° C.;

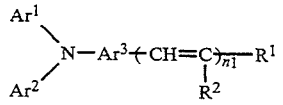

(1)

wherein $Ar^1$ and $Ar^2$ are aromatic ring groups, $Ar^3$ is a bivalent aromatic ring group or a bivalent heterocyclic group, $R^1$ is an alkyl group or an aromatic ring group, $R^2$ is a hydrogen atom, an alkyl group or an aromatic ring group, and $n_1$ is 1 or 2, $R^1$ and $R^2$ may be joined together to form a ring when $n_1=1$:

(B) triarylamine compounds having a structure expressed by the following formula (2) and a melting point not higher than 150° C.;

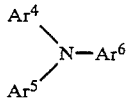

(2)

wherein $Ar^4$, $Ar^5$ and $Ar^6$ are each an aromatic ring group or a heterocyclic group:

(C) hydrazone compounds having a structure expressed by the following formula (3) and a melting point not higher than 155° C.;

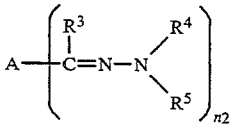

(3)

wherein $R^3$ is a hydrogen atom or an alkyl group, $R^4$ and $R^5$ are alkyl groups, aralkyl groups or aromatic ring groups, $n_2$ is 1 or 2, A is an aromatic ring group, a heterocyclic group or $-CH=C(R^6)R^7$ ($R^6$ and $R^7$ are hydrogen atoms, aromatic ring groups or heterocyclic groups, provided that $R^6$ and $R^7$ are not both hydrogen atoms at the same time).

In the formula (1), $Ar^1$ and $Ar^2$ are each an aromatic ring group such as phenyl, naphthyl and anthryl. $Ar^3$ is a bivalent aromatic ring group or a bivalent heterocyclic group derived from removing two hydrogen atoms from such an aromatic ring as benzene, naphthalene and anthracene, or such a heterocyclic group as thiophene and furan. $R^1$ is an alkyl group such as methyl, ethyl, propyl and butyl, or an aromatic ring group such as phenyl and naphthyl. $R^2$ is an alkyl group such as methyl, ethyl, propyl and butyl; an aromatic ring group such as phenyl and naphthyl; or a hydrogen atom.

$Ar^1$, $Ar^2$, $Ar^3$, $R^1$ and $R^2$ each may have substituents. Examples of possible substituents include an alkyl group such as methyl, ethyl, propyl and butyl; an alkoxy group such as methoxy, ethoxy and propoxy; an aryloxy group such as phenoxy and naphtoxy; a halogen atom such as fluorine, chlorine and bromine; or a di-substituted amino group such as dimethylamino, diethylamino and diphenylamino. Further, when $n_1=1$, $R^1$ and $R^2$ may link to form a ring directly or via an atom such as carbon, sulfur and oxygen.

In the formula (2), $Ar^4$, $Ar^5$ and $Ar^6$ are each an aromatic ring group such as phenyl, naphthyl, anthryl, pyrenyl, fluorenyl, phenanthryl, 9,10-dihydrophenanthryl and fluorenonyl, or a heterocyclic group such as pyridyl, quinolyl, dibenzothienyl, dibenzofuryl, N-methylcarbazole, N-ethylcarbazole and N-tolylcarbazole.

The aromatic ring groups or the heterocyclic groups of $Ar^4$, $Ar^5$ and $Ar^6$ each may have substituents thereof. Examples of possible substituents include an alkyl group such as methyl, ethyl, propyl and butyl; an aralkyl group such as benzyl, phenethyl, and naphthylmethyl; an alkoxy group such as methoxy, ethoxy, and propoxy; an aryloxy group such as phenoxy and naphtoxy; a halogen atom such as fluorine, chlorine and bromine; an aromatic ring group such as phenyl and biphenyl; a diaryl amino group such as diphenyl amino and ditolyl amino; a dialkyl amino group such as dimethyl amino and diethyl amino; a diaralkyl amino group such as dibenzyl amino and diphenethyl amino; an alkyl aralkyl amino group such as benzylmethyl amino and benzylethyl amino; a nitro group; or a hydroxy group.

In the formula (3), $R^3$ is an alkyl group such as methyl, ethyl and propyl, or a hydrogen atom. $R^4$ and $R^5$ are each an alkyl group such as methyl, ethyl and propyl, an aralkyl group such as benzyl and phenethyl, or an aromatic ring group such as phenyl, naphthyl and anthryl. Note that $R^4$ and $R^5$ may link to form a ring. $n_2$ is 1 or 2. $R^4$ and $R^5$ each may have substituents thereof. Examples of possible substituents include an alkyl group such as methyl and ethyl; an alkoxy group such as methoxy and ethoxy; or a halogen atom such as fluorine, chlorine and bromine.

A is an aromatic ring group such as phenyl, naphthyl, anthryl and pyrenyl; a heterocyclic group such as thienyl, furyl, N-methylcarbazole and N-ethylcarbazole; or $-CH=C(R^6)R^7$ (where $R^6$ and $R^7$ are hydrogen atoms, aromatic ring groups or heterocyclic groups, provided that $R^6$ and $R^7$ are not both hydrogen atoms at the same time). Those aromatic ring groups and the heterocyclic groups may have substituents. Examples of substituents include an alkyl group such as methyl and ethyl; an alkoxy group such as methoxy and ethoxy; a halogen atom such as fluorine, chlorine and bromine; a dialkyl amino group such as dimethyl amino and diethyl amino; a diaralkyl amino group such as dibenzyl amino and diphenethyl amino; or a diaryl amino group such as diphenyl amino and di (p-tolyl) amino.

Enumerated below are styryl compounds having the structure expressed by the formula (1) and their melting points. Of the illustrated compounds, No. (1)-1 to (1)-22 are styryl compounds having a melting point not higher than 135° C. and used in the present invention, whereas No. (1)-23 to (1)-40 are styryl compounds having the structure expressed by the formula (1), but of which melting points are higher than 135° C., and thus departing from the scope of the present invention. It should be understood that the kinds of styryl compounds usable in the present invention are of course not limited to the following examples.

| No. | STRUCTURAL FORMULA | MELTING POINT (°C.) |
|---|---|---|
| (1)-1 | 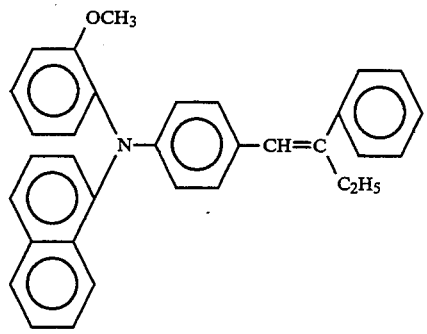 | (Oily) |
| (1)-2 | 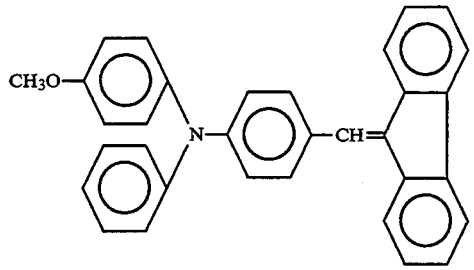 | (Oily) |

-continued
| No. | STRUCTURAL FORMULA | MELTING POINT (°C.) |
|---|---|---|
| (1)-3 | 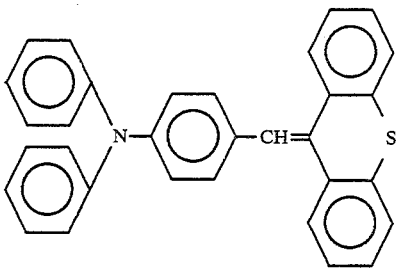 | 47.0~50.0 |
| (1)-4 | 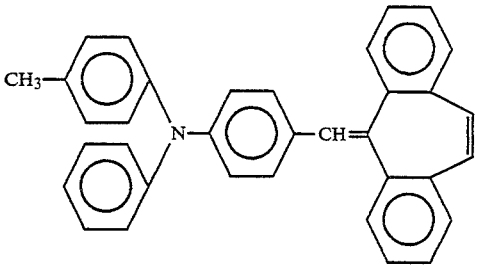 | 52.0~53.0 |
| (1)-5 | 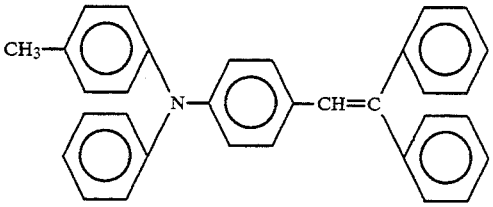 | 56.0~58.0 |
| (1)-6 | 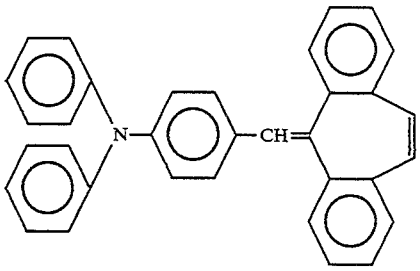 | 83.5~84.5 |
| (1)-7 | 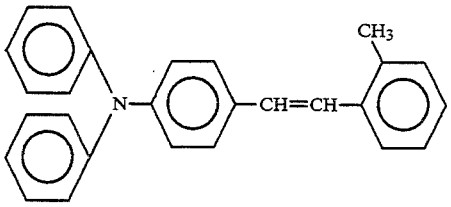 | 84.0~85.0 |
| (1)-8 | 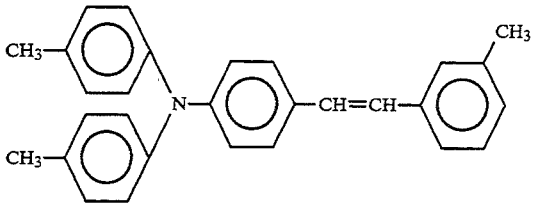 | 89.0~91.0 |

-continued
| No. | STRUCTURAL FORMULA | MELTING POINT (°C.) |
|---|---|---|
| (1)-9 | 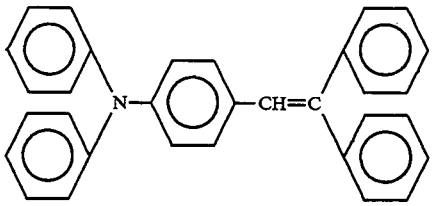 | 94.0~95.0 |
| (1)-10 | 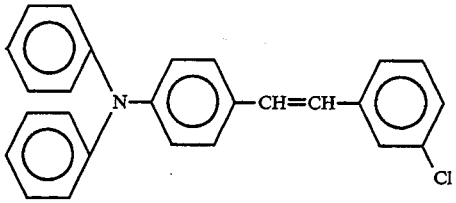 | 100.0~101.0 |
| (1)-11 | 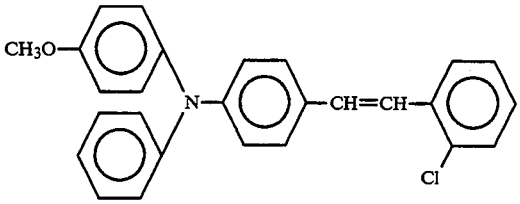 | 104.0~105.0 |
| (1)-12 | 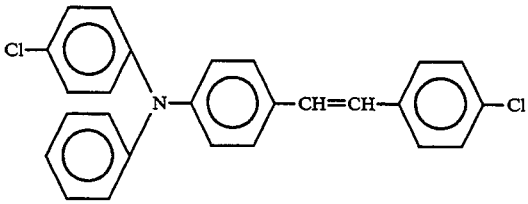 | 108.0~109.0 |
| (1)-13 | 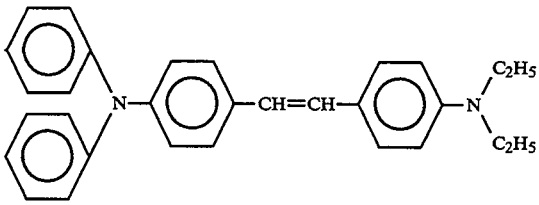 | 109.5~110.5 |
| (1)-14 | 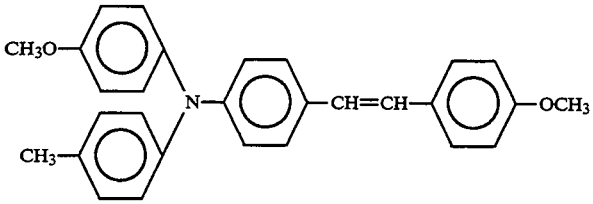 | 110.0~111.0 |
| (1)-15 | 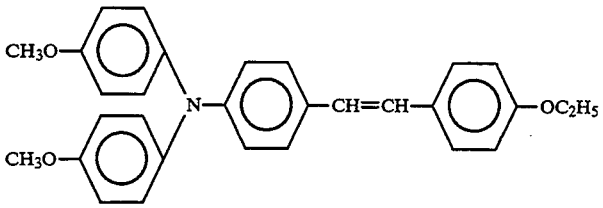 | 119.0~120.0 |

-continued
| No. | STRUCTURAL FORMULA | MELTING POINT (°C.) |
|---|---|---|
| (1)-16 | 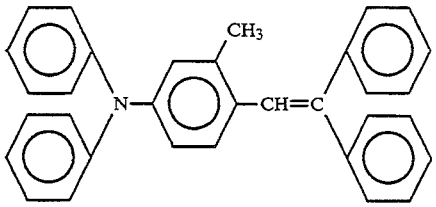 | 120.5~121.5 |
| (1)-17 | 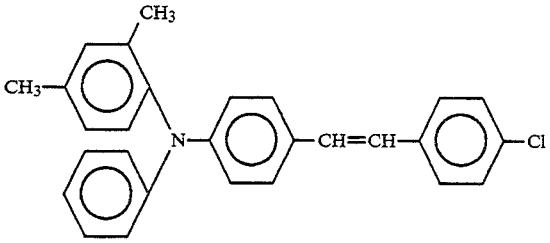 | 123.0~124.5 |
| (1)-18 | 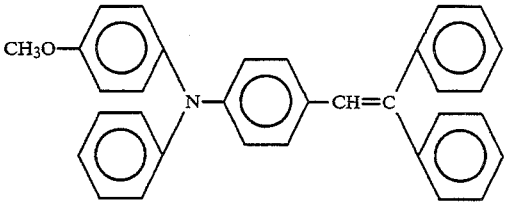 | 125.5~126.5 |
| (1)-19 | 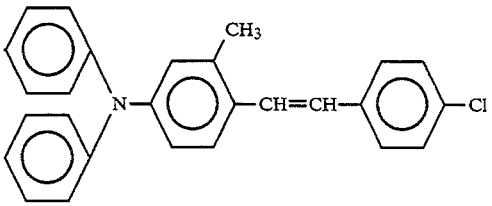 | 127.5~128.0 |
| (1)-20 | 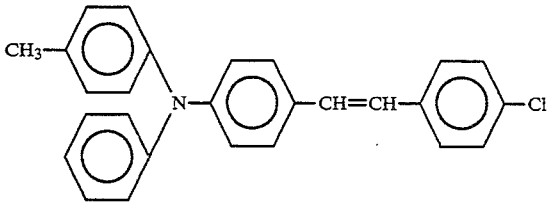 | 128.5~129.5 |
| (1)-21 | 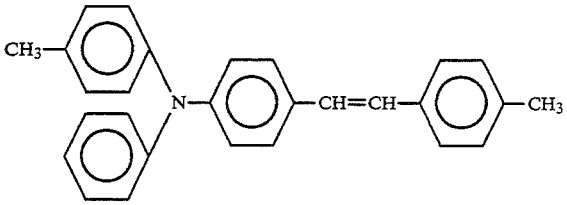 | 131.5~132.5 |
| (1)-22 | 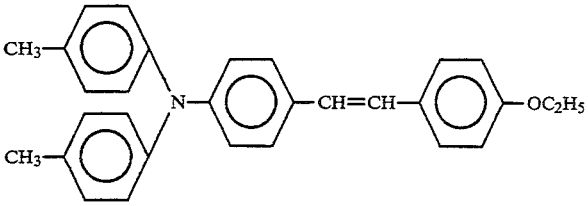 | 132.5~133.5 |

-continued
| No. | STRUCTURAL FORMULA | MELTING POINT (°C.) |
|---|---|---|
| (1)-23 | 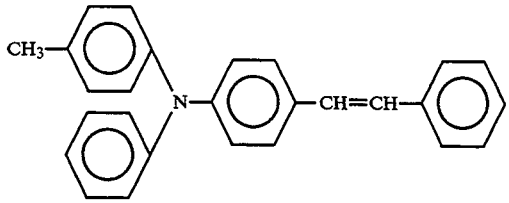 | 136.5~137.5 |
| (1)-24 | 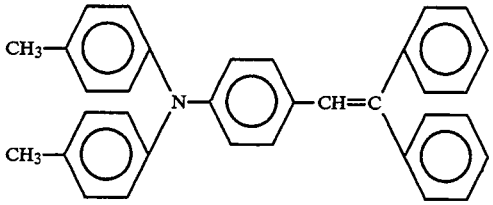 | 139.0~140.0 |
| (1)-25 | 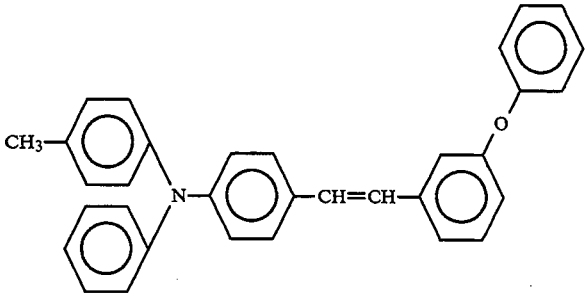 | 141.5~142.5 |
| (1)-26 | 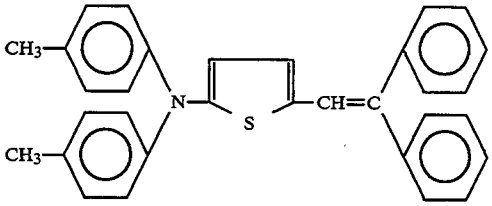 | 142.0~143.0 |
| (1)-27 | 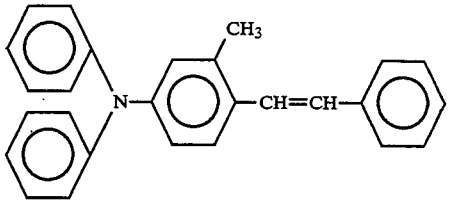 | 150.0~151.0 |
| (1)-28 | 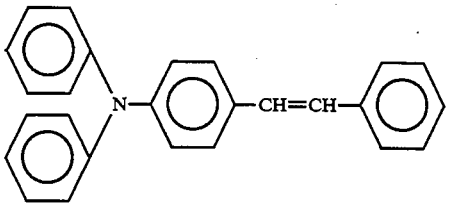 | 152.0~153.0 |

-continued
| No. | STRUCTURAL FORMULA | MELTING POINT (°C.) |
|---|---|---|
| (1)-29 | 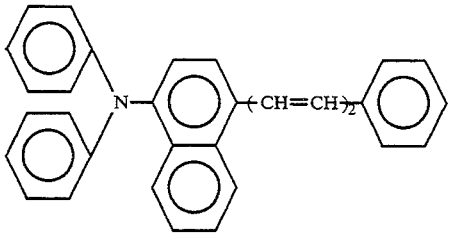 | 153.0~154.5 |
| (1)-30 | 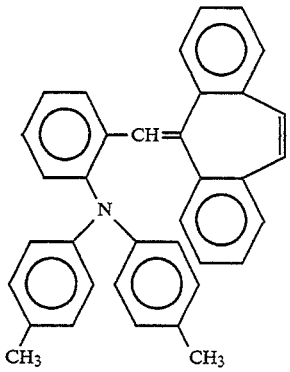 | 153.5~154.5 |
| (1)-31 | 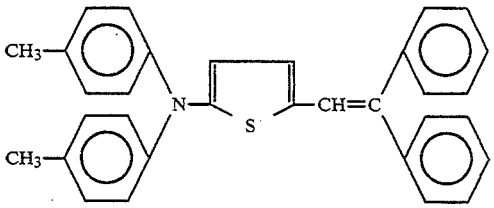 | 155.5~157.0 |
| (1)-32 | 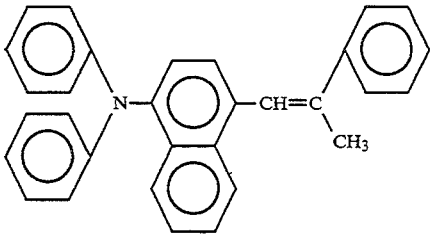 | 157.5~158.5 |
| (1)-33 | 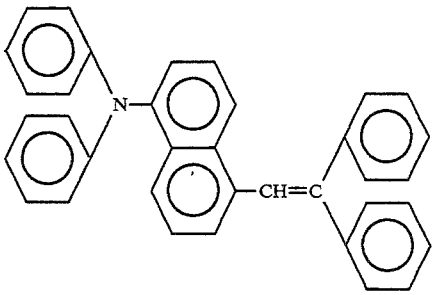 | 157.5~158.5 |

-continued

| No. | STRUCTURAL FORMULA | MELTING POINT (°C.) |
|---|---|---|
| (1)-34 | 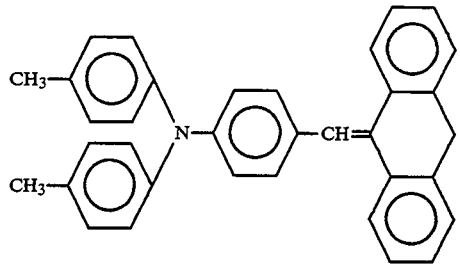 | 158.5~159.7 |
| (1)-35 | 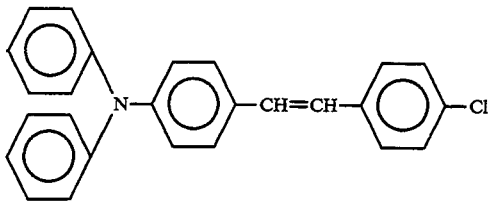 | 159.5~161.0 |

Enumerated below are triarylamine compounds having the structure expressed by the formula (2) and their melting points. Of the illustrated compounds, No. (2)-1 to (2)-45 are triarylamine compounds having a melting point not higher than 150° C. and used in the present invention, whereas No. (2)-46 to (2)-72 are triarylamine compounds having the structure expressed by the formula (2), but of which melting points are higher than 150° C., and thus departing from the scope of the present invention. It should be understood that the kinds of triarylamine compounds usable in the present invention are of course not limited to the following examples.

| No. | STRUCTURAL FORMULA | MELTING POINT (°C.) |
|---|---|---|
| (1)-36 | 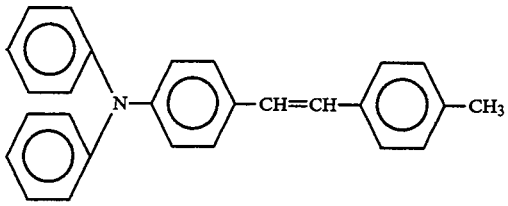 | 162.0~163.0 |
| (1)-37 | 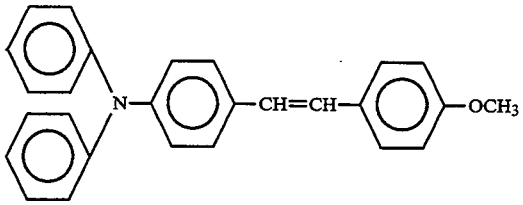 | 167.5~168.5 |
| (1)-38 | 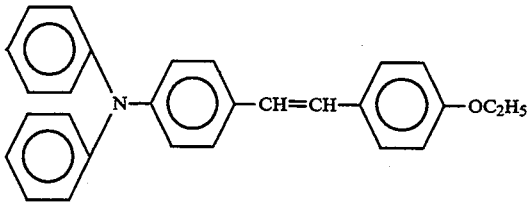 | 168.5~170.0 |

-continued
| No. | STRUCTURAL FORMULA | MELTING POINT (°C.) |
|---|---|---|
| (1)-39 | 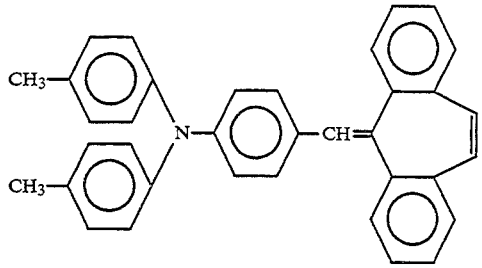 | 169.0~170.0 |
| (1)-40 | 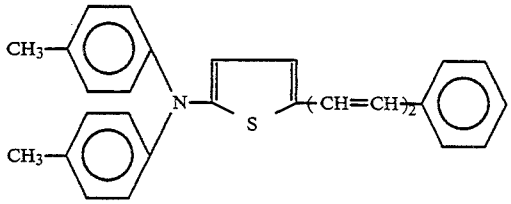 | 175.0~176.5 |
| (2)-1 | 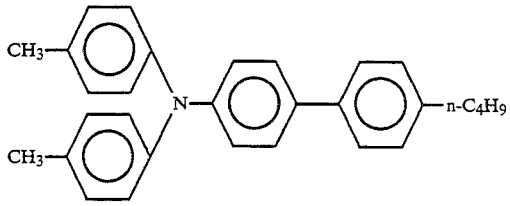 | (Oily) |
| (2)-2 | 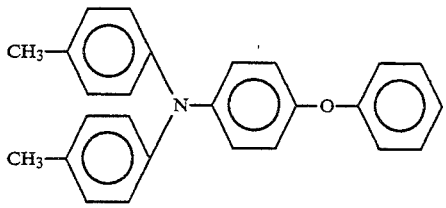 | (Oily) |
| (2)-3 | 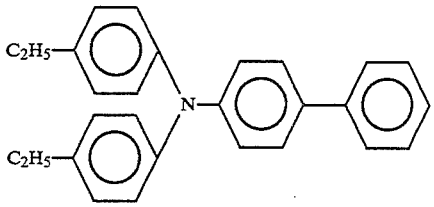 | 69~71 |
| (2)-4 | 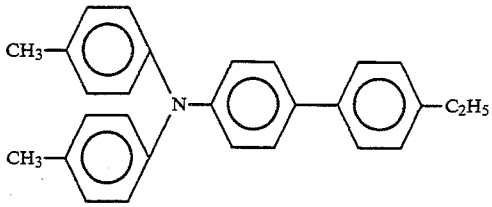 | 80.5~81.5 |

-continued
| No. | STRUCTURAL FORMULA | MELTING POINT (°C.) |
|---|---|---|
| (2)-5 | 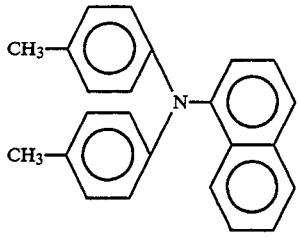 | 82~84 |
| (2)-6 | 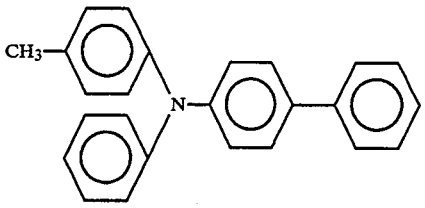 | 92~94 |
| (2)-7 | 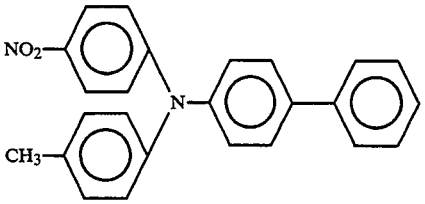 | 95~97 |
| (2)-8 | 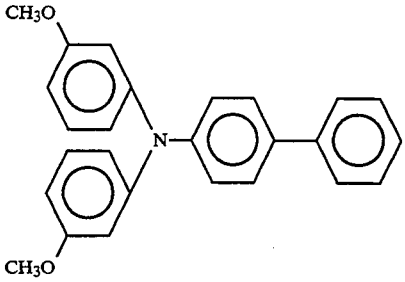 | 96~97 |
| (2)-9 | 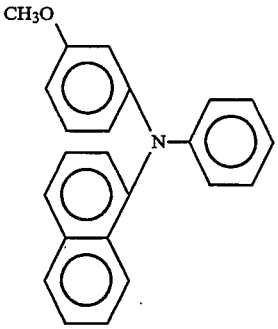 | 96~98 |
| (2)-10 | 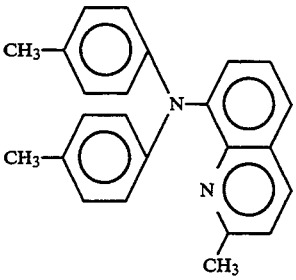 | 99~100 |

-continued
| No. | STRUCTURAL FORMULA | MELTING POINT (°C.) |
|---|---|---|
| (2)-11 | 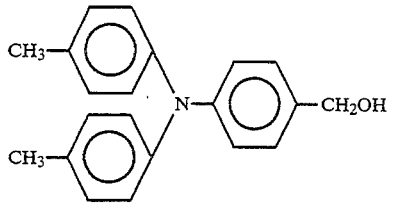 | 100~101 |
| (2)-12 | 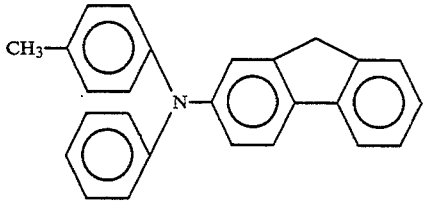 | 99.5~101.5 |
| (2)-13 | 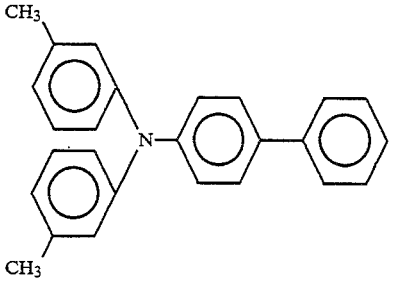 | 103~104 |
| (2)-14 | 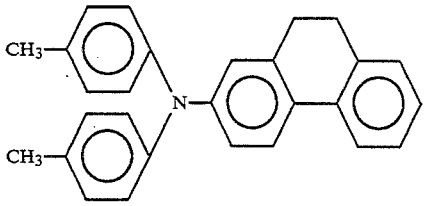 | 104~106 |
| (2)-15 | 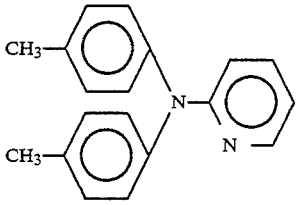 | 105~106.5 |
| (2)-16 | 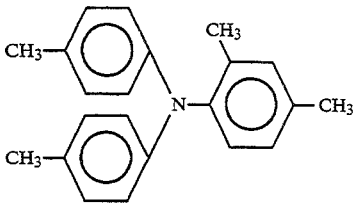 | 105.5~107 |
| (2)-17 | 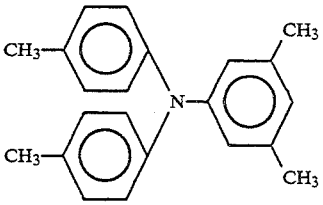 | 108~109 |

-continued
| No. | STRUCTURAL FORMULA | MELTING POINT (°C.) |
|---|---|---|
| (2)-18 | 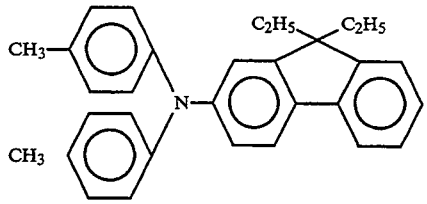 | 114~114.5 |
| (2)-19 | 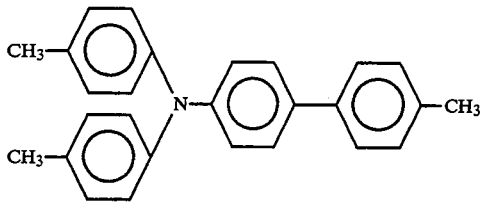 | 116~117 |
| (2)-20 | 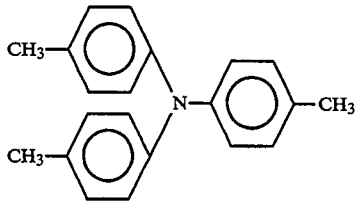 | 116~117 |
| (2)-21 | 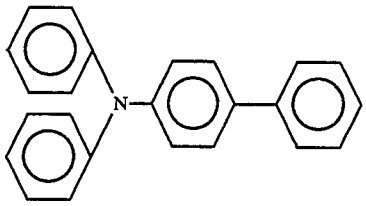 | 116.5~117.5 |
| (2)-22 | 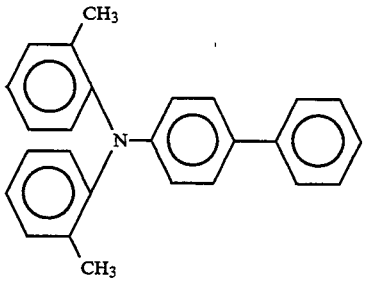 | 118.5~119.5 |
| (2)-23 | 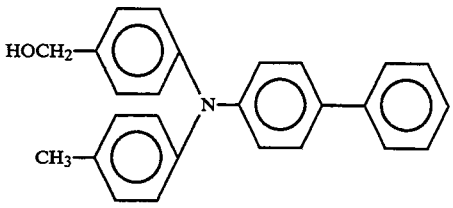 | 120~122 |
| (2)-24 | 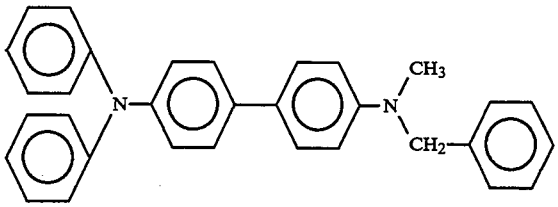 | 120.5~121.5 |

-continued
| No. | STRUCTURAL FORMULA | MELTING POINT (°C.) |
|---|---|---|
| (2)-25 | 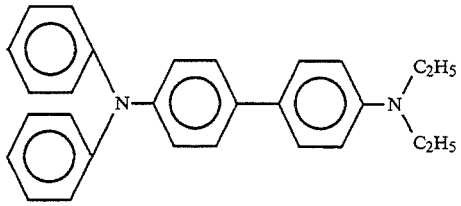 | 121~122 |
| (2)-26 | 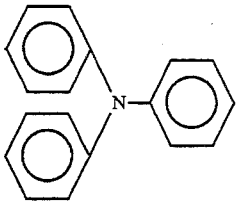 | 125~127 |
| (2)-27 | 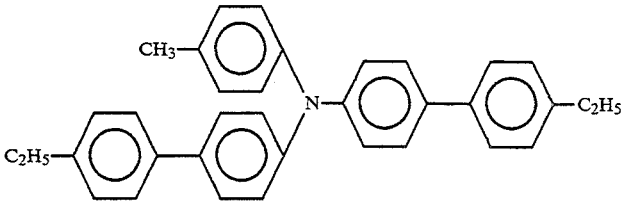 | 125.5~126.5 |
| (2)-28 | 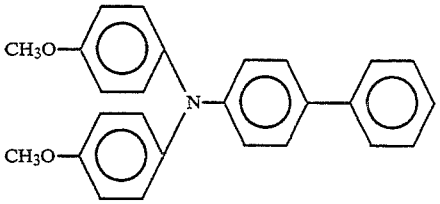 | 127.5~128.5 |
| (2)-29 | 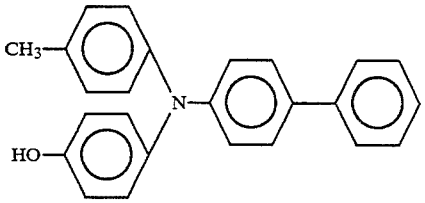 | 128~129.5 |
| (2)-30 | 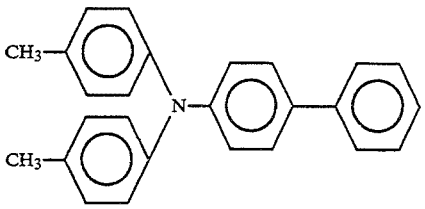 | 128.5~129.5 |
| (2)-31 | 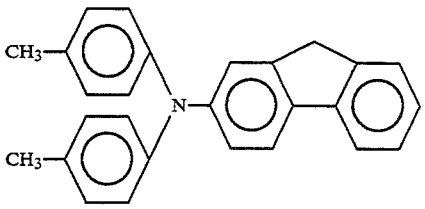 | 128~129 |

-continued
| No. | STRUCTURAL FORMULA | MELTING POINT (°C.) |
|---|---|---|
| (2)-32 | 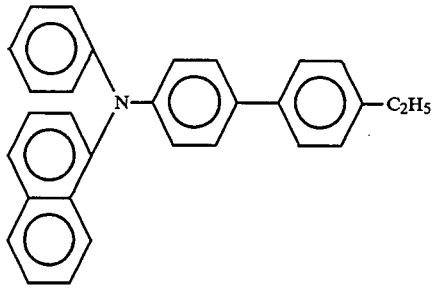 | 128~130 |
| (2)-33 | 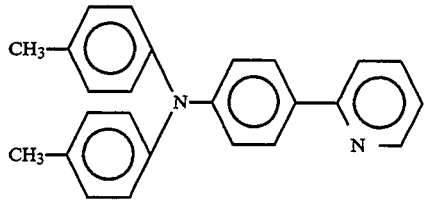 | 129~130 |
| (2)-34 | 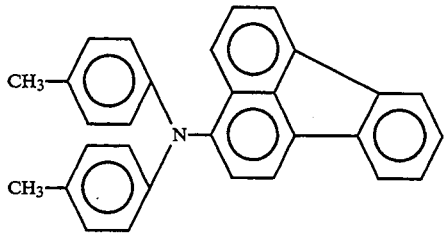 | 129~131 |
| (2)-35 | 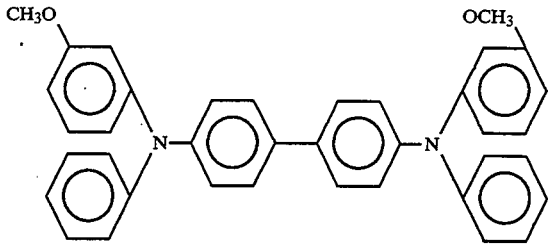 | 129~131 |
| (2)-36 | 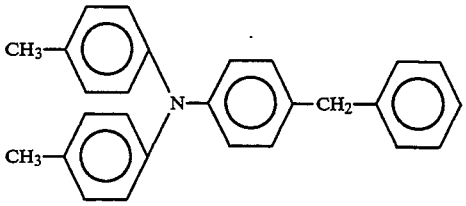 | 132~134 |
| (2)-37 | 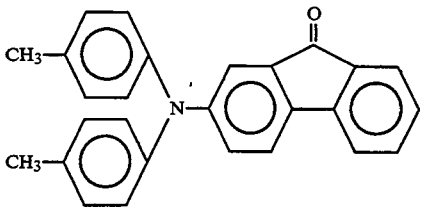 | 133.5~135.0 |

-continued
| No. | STRUCTURAL FORMULA | MELTING POINT (°C.) |
|---|---|---|
| (2)-38 | 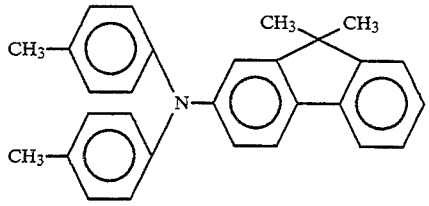 | 141.0~142.0 |
| (2)-39 | 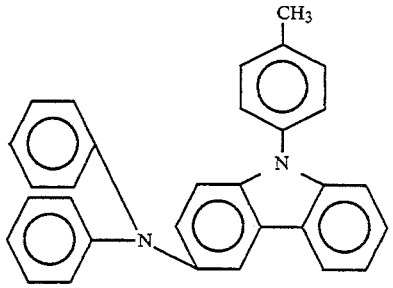 | 141.0~143.0 |
| (2)-40 | 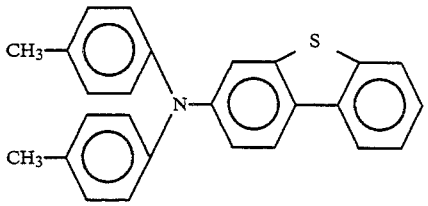 | 142~144 |
| (2)-41 | 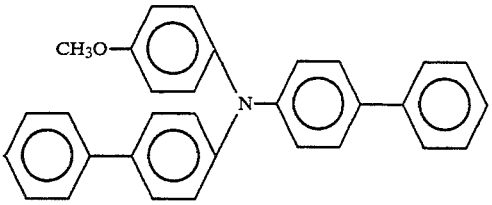 | 142.5~144.5 |
| (2)-42 | 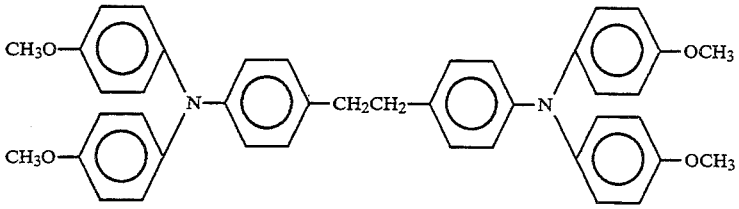 | 144.5~145.5 |
| (2)-43 | 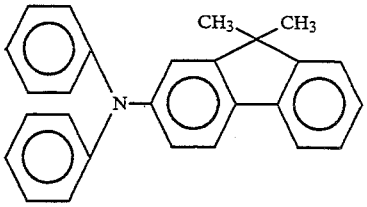 | 144.5~145.5 |

-continued
| No. | STRUCTURAL FORMULA | MELTING POINT (°C.) |
|---|---|---|
| (2)-44 | 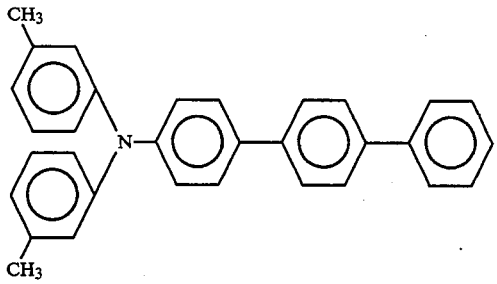 | 146.0~147.0 |
| (2)-45 | 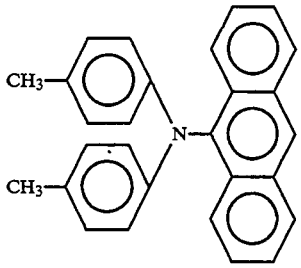 | 146.5~148.0 |
| (2)-46 | 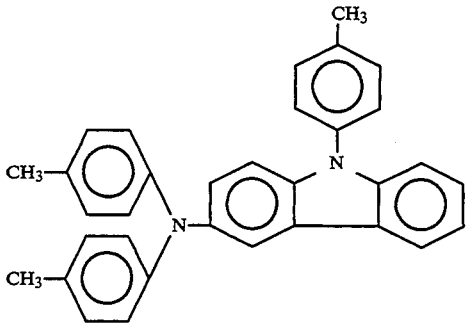 | 151~153 |
| (2)-47 | 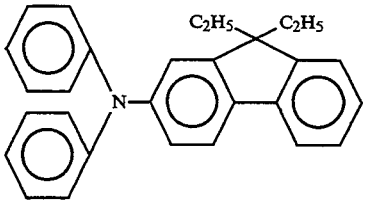 | 152.5~153.5 |
| (2)-48 | 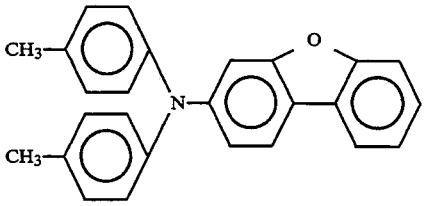 | 153.5~155.0 |
| (2)-49 | 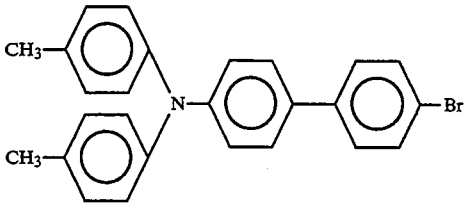 | 156.0~157.5 |

-continued
| No. | STRUCTURAL FORMULA | MELTING POINT (°C.) |
|---|---|---|
| (2)-50 | 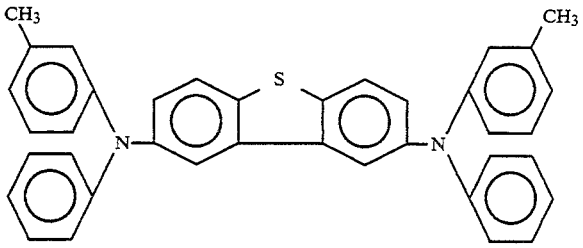 | 161.0~162.0 |
| (2)-51 | 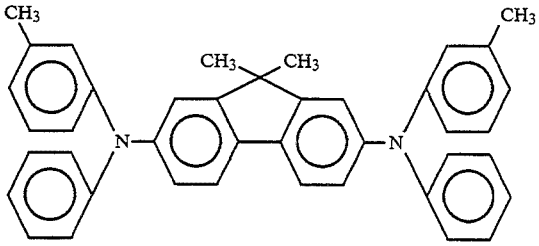 | 163.5~165.0 |
| (2)-52 | 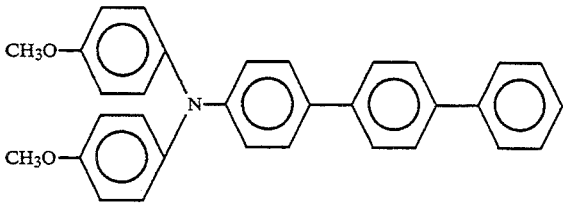 | 164.0~165.0 |
| (2)-53 | 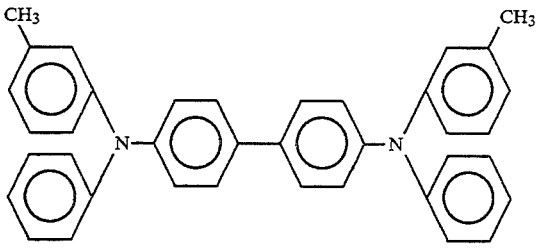 | 168.0~169.0 |
| (2)-54 | 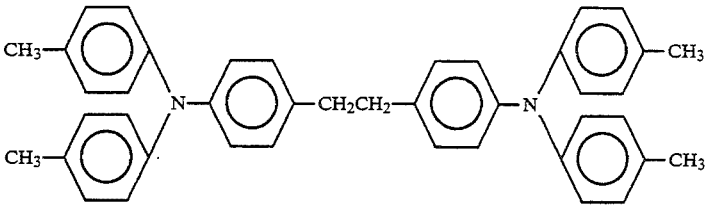 | 172.0~174.0 |
| (2)-55 | 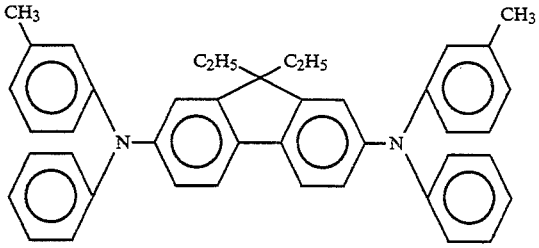 | 175.0~176.0 |

-continued
| No. | STRUCTURAL FORMULA | MELTING POINT (°C.) |
|---|---|---|
| (2)-56 | 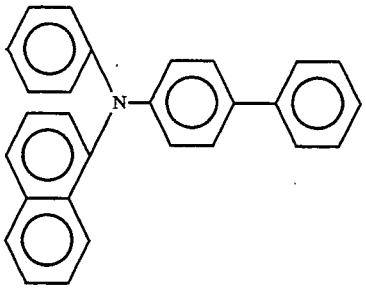 | 176.5~177.5 |
| (2)-57 | 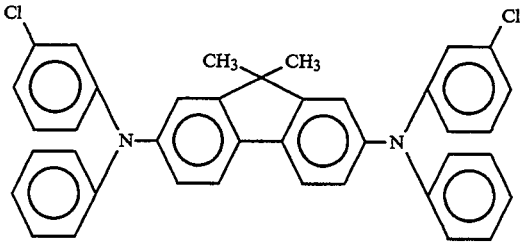 | 177.0~178.5 |
| (2)-58 | 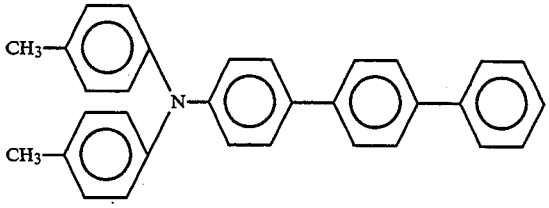 | 180.0~181.0 |
| (2)-59 | 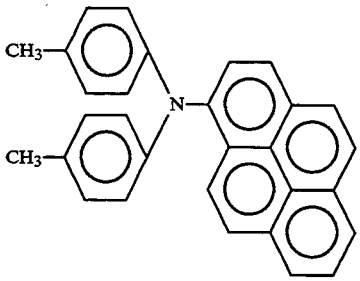 | 181.0~182.0 |
| (2)-60 | 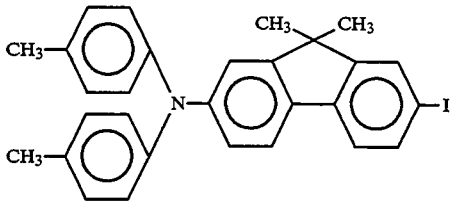 | 182.5~183.5 |
| (2)-61 | 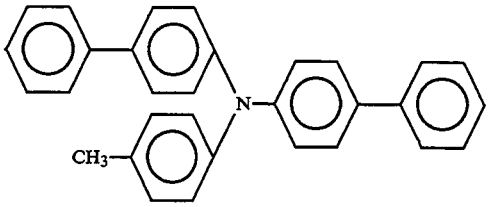 | 187.0~188.0 |

-continued
| No. | STRUCTURAL FORMULA | MELTING POINT (°C.) |
|---|---|---|
| (2)-62 | 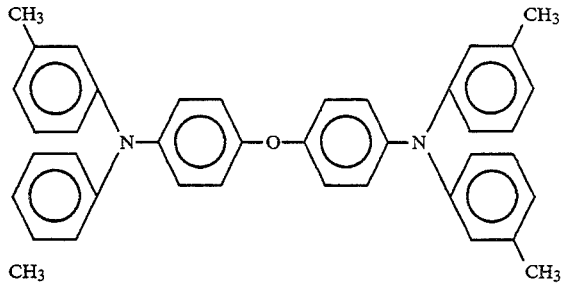 | 187.5~189.0 |
| (2)-63 | 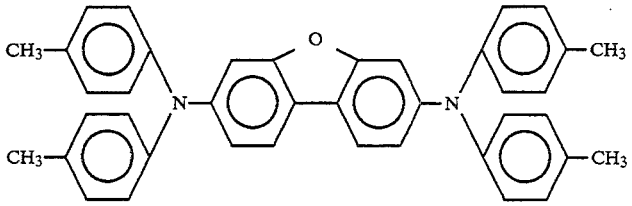 | 190.0~191.0 |
| (2)-64 | 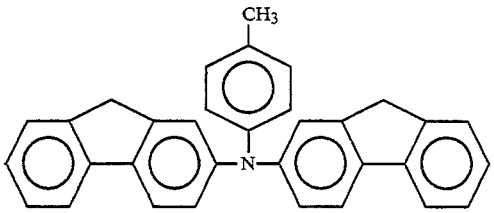 | 191.0~192.0 |
| (2)-65 | 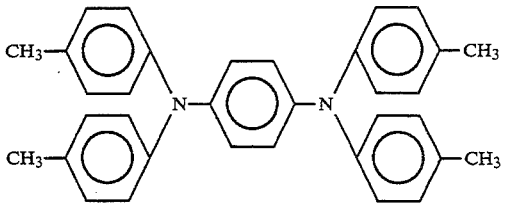 | 193.0~195.0 |
| (2)-66 | 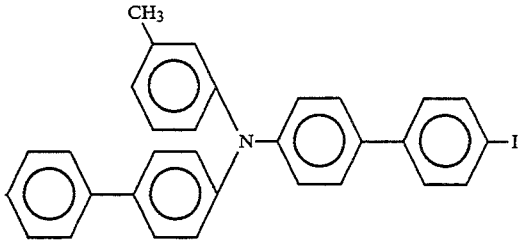 | 194.0~196.0 |
| (2)-67 | 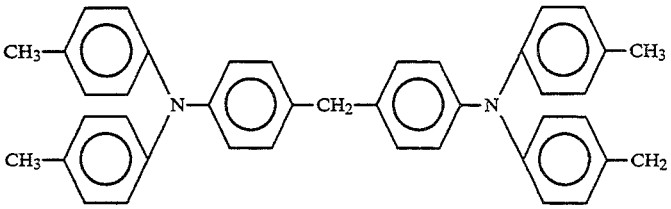 | 194.5~196.0 |

-continued

| No. | STRUCTURAL FORMULA | MELTING POINT (°C.) |
|---|---|---|
| (2)-68 | 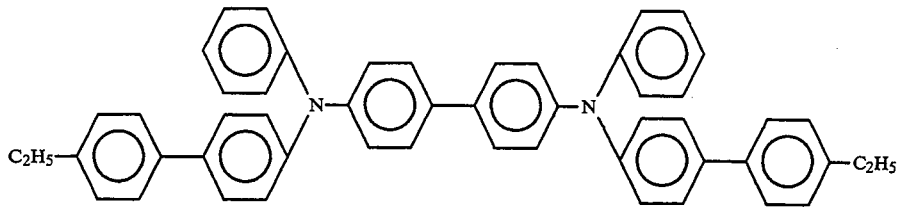 | 202.5~203.5 |
| (2)-69 | 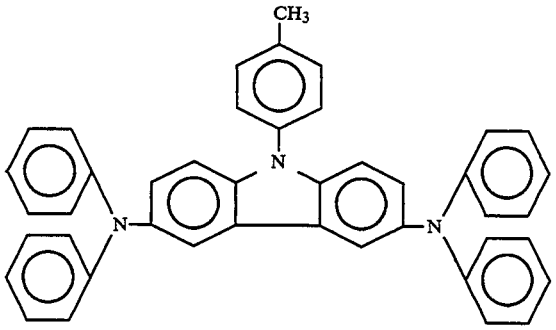 | 211.0~212.5 |
| (2)-70 | 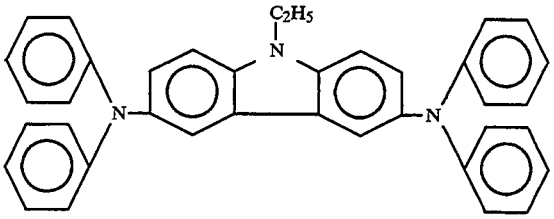 | 219.0~220.0 |
| (2)-71 | 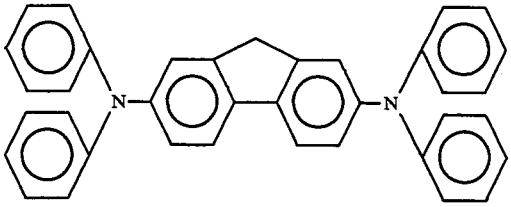 | 240.0~241.0 |
| (2)-72 | 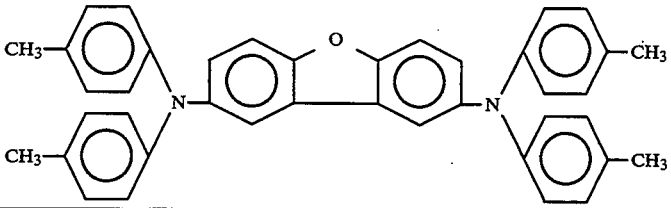 | 243.0~244.5 |

Enumerated below are hydrazone compounds having the structure expressed by the formula (3) and their melting points. Of the illustrated compounds, No. (3)-1 to (3)-27 are hydrazone compounds having a melting point not higher than 155° C. and used in the present invention, whereas No. (3)-28 to (3)-47 are hydrazone compounds having the structure expressed by the formula (3), but of which melting points are higher than 155° C., and thus departing from the scope of the present invention. It should be understood that the kinds of hydrazone compounds usable in the present invention are of course not limited to the following examples.

| No. | STRUCTURAL FORMULA | MELTING POINT (°C.) |
|---|---|---|
| (3)-1 | 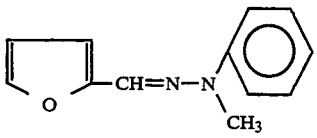 | 48.5~50 |

-continued
| No. | STRUCTURAL FORMULA | MELTING POINT (°C.) |
|---|---|---|
| (3)-2 | 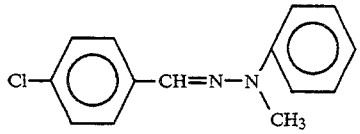 | 68~69 |
| (3)-3 | 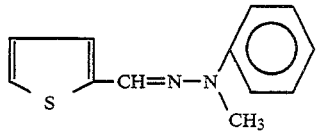 | 81~82 |
| (3)-4 | 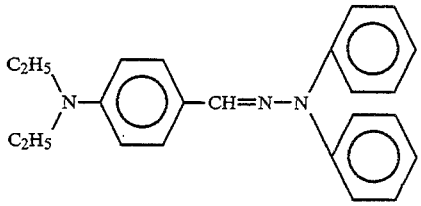 | 93~94 |
| (3)-5 | 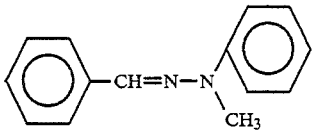 | 103~104 |
| (3)-6 | 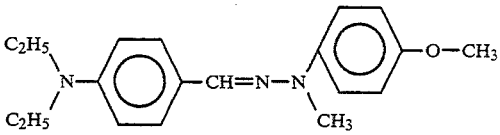 | 104~105 |
| (3)-7 | 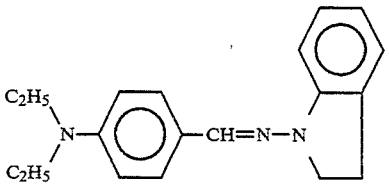 | 106~107 |
| (3)-8 | 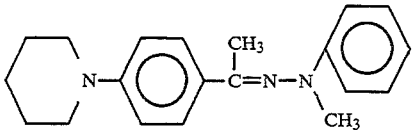 | 107~108 |
| (3)-9 | 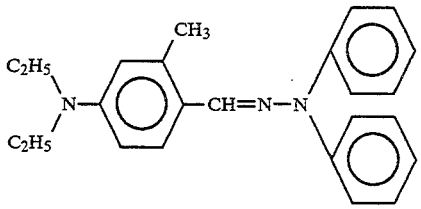 | 110~111 |
| (3)-10 | 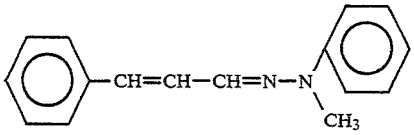 | 112~113 |

-continued
| No. | STRUCTURAL FORMULA | MELTING POINT (°C.) |
|---|---|---|
| (3)-11 | 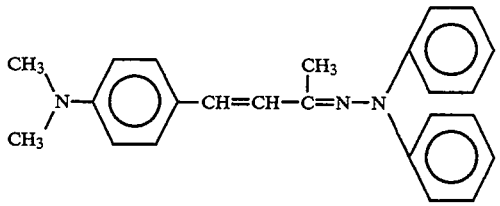 | 119~120 |
| (3)-12 | 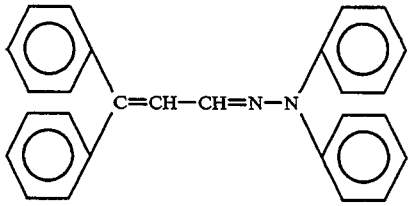 | 118~123 |
| (3)-13 | 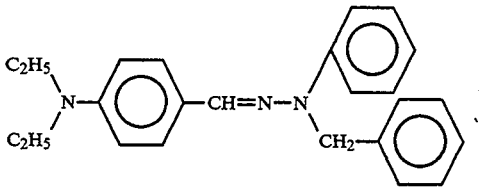 | 123~124 |
| (3)-14 | 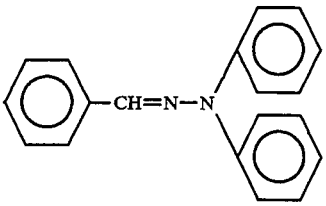 | 124~124.5 |
| (3)-15 | 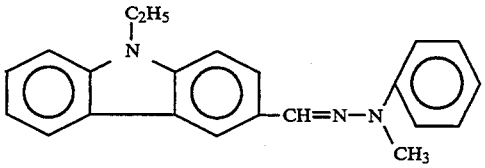 | 129~130 |
| (3)-16 | 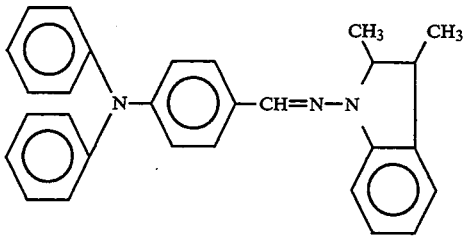 | 132~134 |
| (3)-17 | 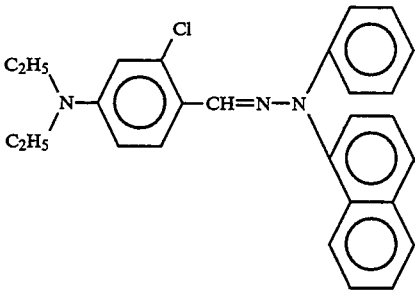 | 133.5~134.5 |

-continued
| No. | STRUCTURAL FORMULA | MELTING POINT (°C.) |
|---|---|---|
| (3)-18 | 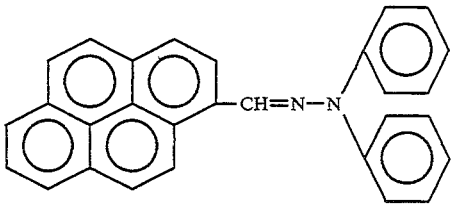 | 134~135 |
| (3)-19 | 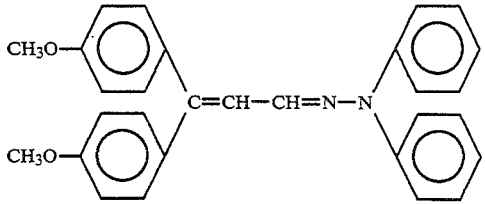 | 135~137 |
| (3)-20 | 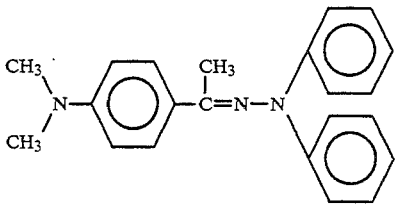 | 137~138 |
| (3)-21 | 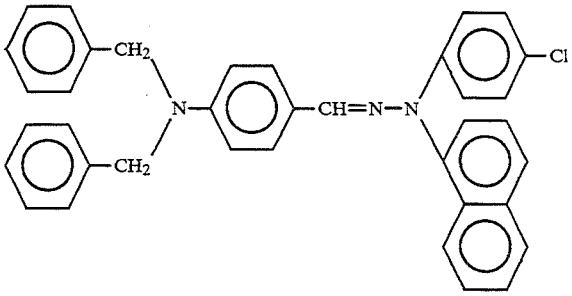 | 142~143.5 |
| (3)-22 | 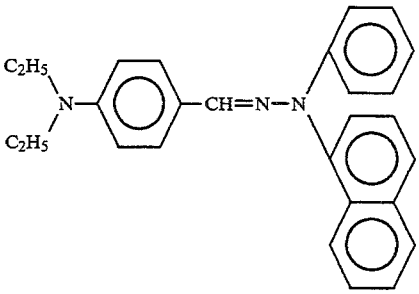 | 144~145 |
| (3)-23 | 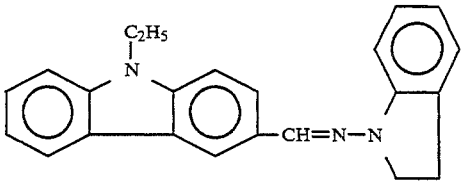 | 144~145 |

-continued
| No. | STRUCTURAL FORMULA | MELTING POINT (°C.) |
|---|---|---|
| (3)-24 | 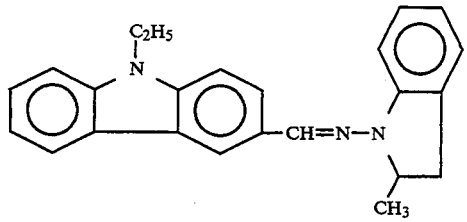 | 148~149 |
| (3)-25 | 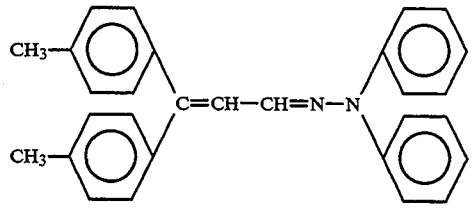 | 152~154 |
| (3)-26 | 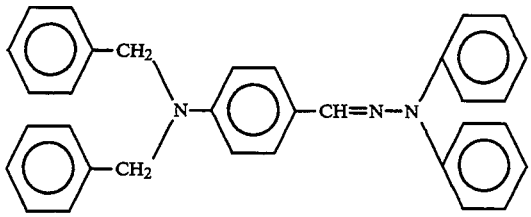 | 153~154 |
| (3)-27 | 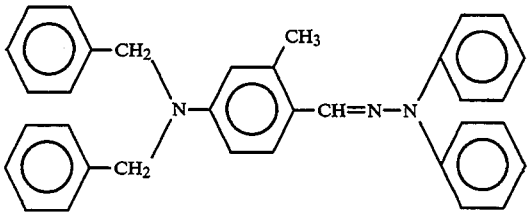 | 154~155 |
| (3)-28 | 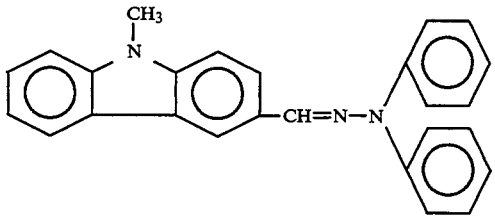 | 156~157 |
| (3)-29 | 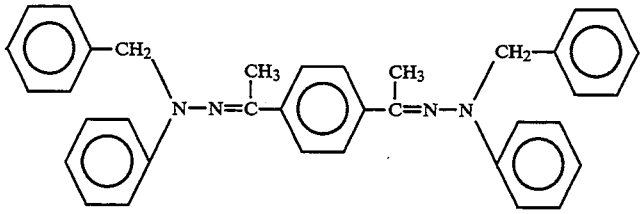 | 159~160 |
| (3)-30 | 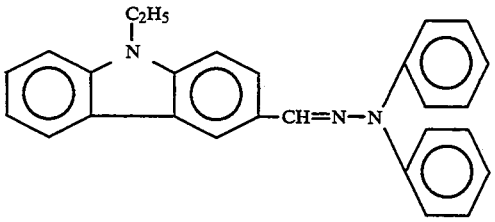 | 160~165.5 |

-continued
| No. | STRUCTURAL FORMULA | MELTING POINT (°C.) |
|---|---|---|
| (3)-31 | 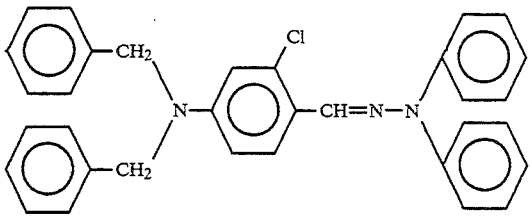 | 161~162 |
| (3)-32 | 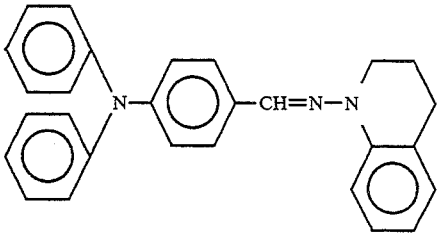 | 167~168 |
| (3)-33 | 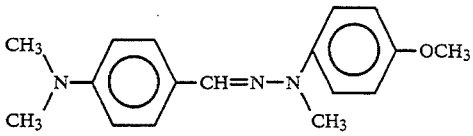 | 167~168 |
| (3)-34 | 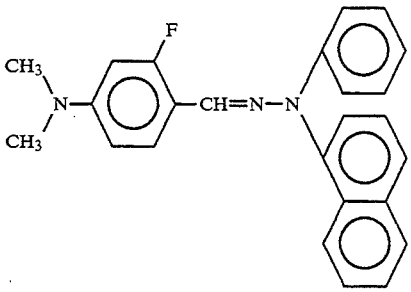 | 168~169 |
| (3)-35 | 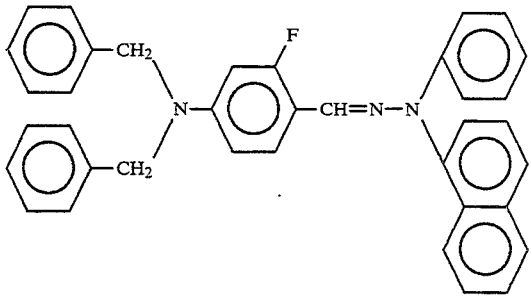 | 173~174 |
| (3)-36 | 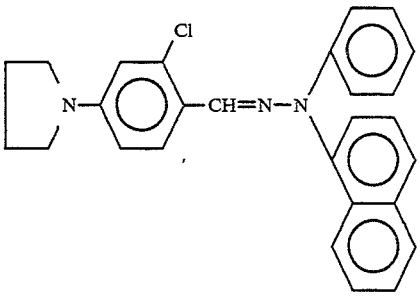 | 173~174 |

-continued
| No. | STRUCTURAL FORMULA | MELTING POINT (°C.) |
|---|---|---|
| (3)-37 | 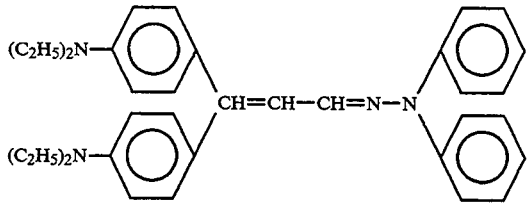 | 173~175 |
| (3)-38 | 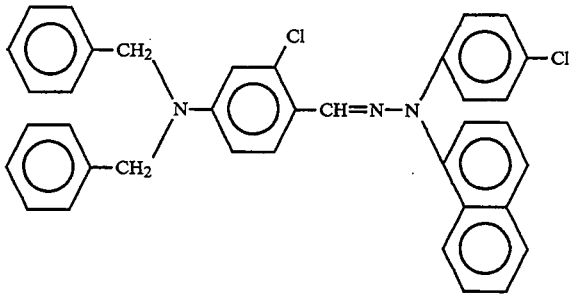 | 174.5~175.5 |
| (3)-39 | 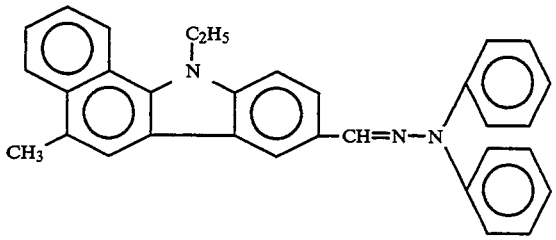 | 174.5~175.5 |
| (3)-40 | 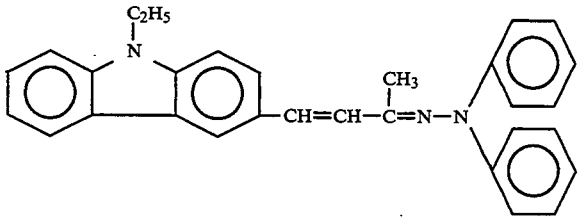 | 175~176.5 |
| (3)-41 | 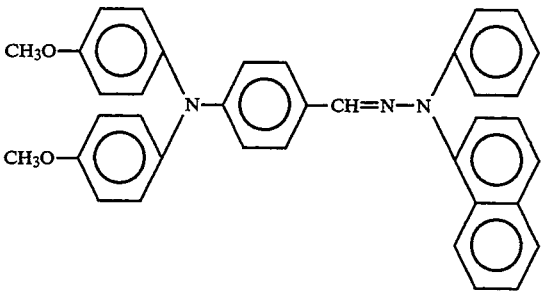 | 176~177 |
| (3)-42 | 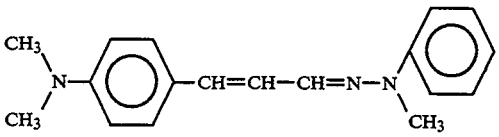 | 176~177.5 |

-continued

| No. | STRUCTURAL FORMULA | MELTING POINT (°C.) |
|---|---|---|
| (3)-43 | 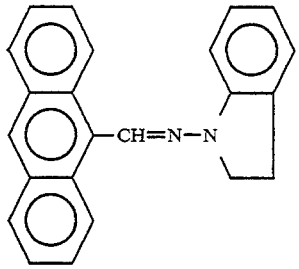 | 186~187 |
| (3)-44 | 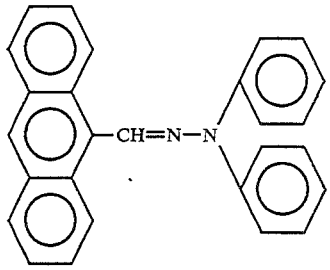 | 196~197 |
| (3)-45 | 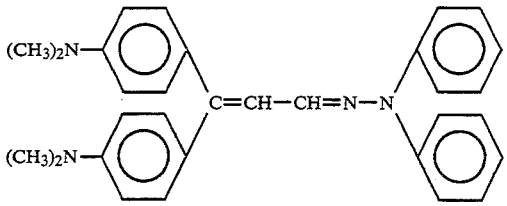 | 197~198 |
| (3)-46 | 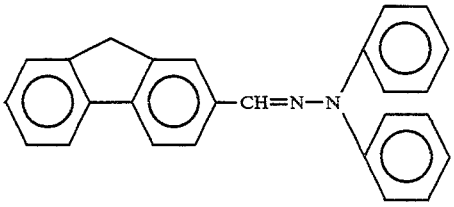 | 204~205 |
| (3)-47 | 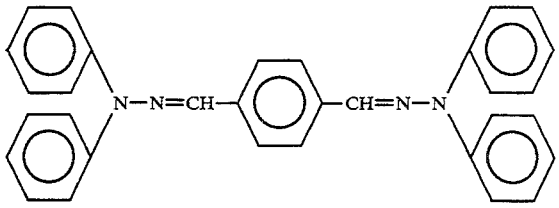 | 241~242 |

The photosensitive layer of the electrophotographic photosensitive member in the present invention may be of either the single-layer type that a charge generating material and a charge transporting material are contained in the same layer, or the laminated type that a charge transporting layer containing a charge transporting material and a charge generating layer containing a charge generating material are functionally separated from each other.

The laminated type photosensitive layer will now be described. An arrangement of the laminated type photosensitive layer is divided into two types; one formed by laminating the charge transporting layer over the charge generating layer, and the other formed by laminating the charge generating layer over the charge transporting layer.

The charge transporting layer used in the present invention is formed by dissolving at least one of the compounds (A), (B) and (C) as the charge transporting material into resin, which has a film forming ability, using an appropriate solvent to prepare a coating solution, and then applying and drying the coating solution. As such resin, there can be used any kind of resin which has been conventionally employed for the charge transporting layer, in addition to the resin obtained by hardening the acrylic monomer of the present invention, and includes, for instance, polyester, polycarbonate, polymethacrylic acid and polystyrene. The thickness of the charge transporting layer is preferably in a range of 5 to 40 μm, more preferably, in a range of 10 to 30 μm. In the present invention, the charge transporting layer may be further added with any other suitable charge transporting materials than the compounds (A), (B) and (C).

The charge generating layer in the present invention is formed by dispersing a charge generating material into bonding resin to prepare a dispersed solution, and then coating and drying the dispersed solution. As such bonding resin, there can be used the resin of the present invention which is obtained by hardening acrylic monomer and includes, for instance, polyvinyl butyral, polystyrene, polyvinyl acetate, acrylic resin, cellulose acetate and ethyl cellulose. Examples of the charge generating material include azo pigment such as Sudan red and Dian blue; quinone pigment such as pyrene quinone and anth-anthrone; quinocyanine pigment; perylene pigment; indigo pigment such as indigo and thioindigo; azulenium salt pigment; or phthalocyanine pigment such as copper phthalocyanine and titanyl phthalocyanine. The thickness of the charge generating layer is preferably not greater than 5 μm, more preferably in a range of 0.05 to 2 μm.

The single-layer type photosensitive layer will be next described. The single-layer type photosensitive layer is formed by preparing such a solution that at least one of the compounds (A), (B) and (C) and the charge generating material are dissolved and dispersed into the aforesaid resin, and then coating and drying the solution. The thickness of the single-layer type photosensitive layer is preferably in a range of 5 to 40 μm, more preferably in a range of 10 to 30 μm.

The conductive support for use in the present invention may be of any material so long as it has conductivity, which includes, for instance, a metal or an alloy such as aluminum, chromium, nickel, stainless steel, copper and zinc; a composite formed by laminating a metal foil, such as aluminum and copper, over a plastic film; another composite by coating aluminum, indium oxide, tin oxide and the like over a plastic film with vapor deposition; or a metal, a plastic film, paper and the like on which a conductive layer is provided by coating a conductive material solely or together with appropriate binder resin.

Examples of the conductive material used in that conductive layer include powder, a foil and fibers of a metal such as aluminum, copper, nickel and silver; a conductive metal oxide such as antimony oxide, indium oxide and tin oxide; a high molecular conductive material such as polypyrrole, polyaniline and high molecular electrolyte; carbon black, graphite powder and an organic or inorganic electrolyte; or conductive powder of which surface is coated with any of those conductive materials.

Although the conductive support may be in the form of a drum, sheet, belt or the like, the support is preferably formed into any desired shape optimum for the electrophotographic apparatus in which it is employed.

In addition, an underlying layer may be provided between the conductive support and the photosensitive layer. The underlying layer functions as a barrier layer for controlling injection of charges at the interface between itself and the photosensitive layer, and/or as a bonding layer therebetween. The underlying layer comprises primarily bonding resin, but may contain any of the aforesaid metals and alloys, or oxides and salts thereof, and surface active agents. Examples of the bonding resin forming the underlying layer are polyester, polyurethane, polyacrylate, polyethylene, polystyrene, polybutadiene, polycarbonate, polyamide, polypropylene, polyimide, phenol resin, acrylic resin, silicone resin, epoxy resin, urea resin, allyl resin, alkyd resin, polyamide imide, nylon, polysulphone, polyallyl ether, polyacetal and butyral resin. The film thickness of the underlying layer is preferably in a range of 0.05–7 μm, more preferably in a range of 0.1 to 2 μm.

Each of the above-mentioned layers can be formed by using vapor deposition and coating. Particularly, the coating method is preferable because it can form a wide variety of films ranging from a thin one to a thick one with various compositions. The coating method includes, for instance, immersion coating, spray coating, beam coating, bar coating, blade coating and roller coating.

The electrophotographic photosensitive member of the present invention is applicable to not only electrophotographic copying machines, but also a wide field of electrophotographic applications such as a laser beam printer, CRT printer, LED printer, liquid crystal printer, facsimile machine and laser printing machine.

FIG. 1 shows an example of schematic arrangement of a transfer-type electrophotographic apparatus using an electrophotographic photosensitive member of the present invention.

In FIG. 1, denoted at 1 is a drum-type electrophotographic photosensitive member of the present invention, as an image carrier, which is driven to rotate around a shaft la in the direction of arrow of a predetermined circumferential speed. While making a rotation, the photosensitive member 1 is charged uniformly into a positive or negative predetermined potential on the circumferential surface, and then subjected to an optical image exposure L (such as slit exposure and laser beam scanning exposure) by image exposure means (not shown) at an exposure section 3. Through the above steps, an electrostatic latent image corresponding to the exposure image is successively formed on the circumferential surface of the photosensitive member.

Thereafter, the electrostatic latent image is developed using toner by development means 4, and the toner-developed image is successively transferred by transfer means 5 to the surface of a transfer material P fed from a paper feeder (not shown) between the photosensitive member 1 and the transfer means 5 in synchronism with the rotation of the photosensitive member 1.

The transfer material P having the image transferred thereto is separated from the surface of the photosensitive member and introduced to an image fixing means 8 for fixing of the image, following which it is printed out as a reproduced product (copy) outside of the apparatus.

After the image transfer, the surface of the photosensitive member 1 is cleaned by cleaning means 6 to remove the toner left, and the charges remaining on the surface is removed by pre-exposure means 7 for the repeated image forming.

As the uniformly charging means 2 for the photosensitive member 1, a corona charging device is generally in widespread use. As the transfer means 5, a corona charging device is also generally in widespread use. The electrophotographic apparatus may be arranged such that, of the above components such as the photosensitive member, the development means and the cleaning means, any plural ones are integrated into a device unit, which is attached to the apparatus body in a detachable manner. For instance, it is also possible to integrate the photosensitive member 1 and the cleaning means 6 into a single device unit, and detachably attach the unit to the apparatus body by guide means such as rails provided therein. In this case, the charging means and/or the development means may be further integrated into the device unit.

Where the electrophotographic apparatus is used as a copying machine or a printer, the optical image exposure L is performed by receiving the reflected light or passing light from or through an original, or directly reading the original for conversion into an electric signal, and then scanning a laser beam driving an LED array, or driving a liquid crystal shutter array in response to the electric signal.

Figure 2:
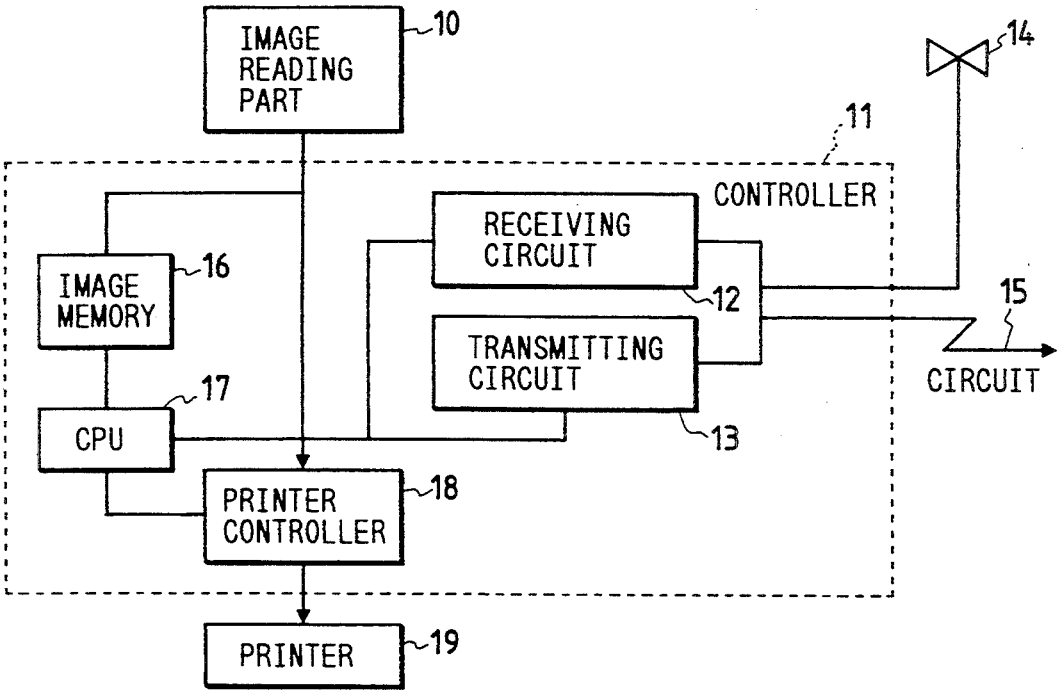
FIG. 2 shows an example of a block diagram of a facsimile machine using the electrophotographic photosensitive member of the present invention.

In the case of using the electrophotographic apparatus as a printer for a facsimile machine, the optical image exposure L is performed to print the received data. FIG. 2 shows an example of this case in the form of a block diagram.

A controller 11 controls an image reading part 10 and a printer 19. The controller 11 is controlled in its entirety by a CPU 17. The read data from the image reading part 10 is transmitted to a partner station via transmitting circuit 13. The data received from the partner station is sent to the printer 19 via a receiving circuit 12. An image memory 16 stores predetermined image data therein. A printer controller 18 controls the printer 19. Denoted at 14 is a telephone set.

The image information received from a line 15 (i.e., the image information received from a remote terminal connected via the line) is demodulated by the receiving circuit 12, decoded by the CPU 17, and then stored in the image memory 16 successively. When the image information of at least one page is stored in the memory 16, image recording of that page takes places. The CPU 17 reads the image information of one page out of the memory 16 and sends the decoded image information of one page to the printer controller 18. Upon receiving the image information of one page from the CPU 17, the printer controller 18 controls the printer 19 to perform the image information recording of that page.

Note that during the recording by the printer 19, the CPU 17 is receiving the image information of next page.

The receiving and recording of images are carried out in this manner.

The present invention is described in more detail with the following examples.

EXAMPLE 1

10 parts of alcohol-soluble copolymer nylon resin (weight-average molecular weight: 29,000) and 30 parts of methoxymethyl 6-nylon resin (weight-average molecular weight: 32,000) were solved into a mixed solvent of 260 parts of methanol and 40 parts of butanol. The mixture was coated over a glass substrate by dipping to form an undercoat layer of 1 μm thickness.

10 parts of the afore-exemplified styryl compound (1)-4 as a charge transport material was solved together with 10 parts of polycarbonate (weight-average molecular weight: 46,000) into a mixed solvent of 20 parts of methylene chloride and 40 parts of chlorobenzene. This solution was coated by dipping on the above undercoat layer, and dried at 120° C. for 60 minutes to form a charge transport layer of 18 μm film thickness.

Dispersed for 12 hours by a sand mill apparatus using glass beads with diameter of 1 mm were 4 parts of disazo pigment represented by the below formula, 2 parts of polyvinyl butyral (rate of butyralization: 68%, weight average molecular weight: 24,000), and 34 parts of cyclohexanone.

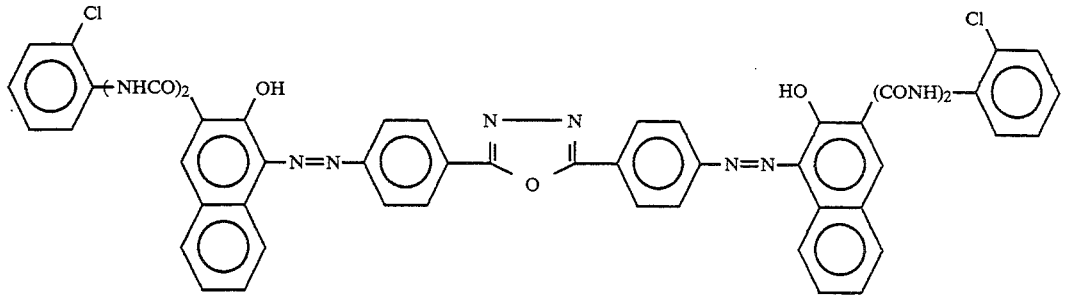

Then, a dispersion liquid for charge generation layer was prepared by adding 60 parts of tetrahydrofuran (THF) into the above dispersed mixture. The dispersion liquid was coated by spraying over the above charge transport layer, and then dried at 80° C. for fifteen minutes to form a charge generation layer of 0.20 μm film thickness, providing a photosensitive layer of laminating type.

Next dispersed for 48 hours by the sand mill were 60 parts of the afore-exemplified acrylic monomer (20), 30 parts of tin oxide ultrafine particles with an average particle diameter before dispersion of 400Å, 2 parts of 2-methylthioxanthone as a photoinitiator, 100 parts of toluene, and 200 parts of methyl cellosolve.

Using the dispersion liquid, a film was formed on the photosensitive layer by beam coating, and then dried. A protection layer was obtained by photo-setting for twenty seconds with a high pressure mercury vapor lamp of 8 mW/cm$^2$ intensity. A film thickness of protection layer was 4 μm. Dispersion in the composition liquid of the protection layer was good and the surface thereof was uniform without unevenness.

The thus formed photosensitive member was observed by a transmission microscope with back light at an angle of 15° to check a degree of cracks appeared. Evaluation was conducted with three ranks of O, A, and x judged from appearance of cracks in the entire field of view by the microscope of 10× magnification. O represents no cracks, A not more than five relatively small cracks within 1 cm, and x more than five cracks or layer crack(s) than 1 cm.

Similar evaluation was performed for the photosensitive members made from other styryl compounds as listed in Table 1. Evaluation results are also shown in Table 1.

TABLE 1

| Exemplified styryl compound No. | Melting Pt. of styryl compound (°C.) | Crack appearance on photosensitive member |
|---|---|---|
| (1)-4 | 52~53 | ○ |
| (1)-6 | 83.5~84.5 | ○ |
| (1)-8 | 89.0~91.0 | ○ |
| (1)-10 | 100~101 | ○ |
| (1)-12 | 108~109 | ○ |
| (1)-17 | 123.0~124.5 | ○ |
| (1)-18 | 125.5~126.5 | ○ |
| (1)-20 | 128.5~129.5 | ○ |
| (1)-22 | 132.5~133.5 | ○ |
| (1)-23 | 136.5~137.5 | Δ |
| (1)-24 | 139~140 | Δ |
| (1)-26 | 142~143 | Δ |
| (1)-29 | 153.5~154.5 | Δ |
| (1)-33 | 157.5~158.5 | x |
| (1)-37 | 167.5~168.5 | x |
| (1)-39 | 169~170 | x |
| (1)-40 | 175~176.5 | x |

As shown in Table 1, as the melting point of charge transport material decreases, the appearance of crack also decreases to become null at and below 135° C.

EXAMPLE 2

A coating material for conductive layer was prepared by dispersing by the sand mill apparatus using the glass beads of 1 mm diameter for two hours 50 parts of conductive titanium oxide powder coated by tin oxide containing antimony oxide of 10%, 25 parts of phenol resin, 20 parts of methyl cellosolve, 5 parts of methanol, and 0.002 parts of silicone oil (polydimethylsiloxane polyoxyalkylene copolymer, average molecular weight: 3,000). The coating material was coated by dipping on an aluminum cylinder ($\phi$30 mm×260 mm), and dried at 140° C. for thirty minutes. A conductive layer of film thickness of 20 $\mu$m was thus formed.

Then an undercoat layer was formed in the same process as in Example 1, and a photosensitive layer and a protection layer were successively layered thereon in the same process as in Example 1 except use of the afore-exemplified styryl compound No. (1)-17 as the charge transport material, providing a photosensitive member.

The thus formed electrophotographic photosensitive member was assembled in a copier of positive development type, which repeats 1.5 sec cycle of charge, exposure, development, transfer, and cleaning processes. Electrophotographic properties were evaluated at the ordinary temperature in the ordinary humidity, and 10,000 times of image formation were repeated as a durability test.

Results are shown in Table 2. As shown in Table 2, the photosensitive member of Example 2 showed the sensitivity and the residual potential equivalent to those of a photosensitive member of Comparative example 1 without a protection layer, while keeping stable images without unevenness and black dot. Further, the photosensitive member of the present invention provided the stable images without occurrence of image degradation such as black band, which is an image defect of black belt.

EXAMPLES 3-7

Photosensitive members were prepared in the same manner as in Example 2 except that used were the afore-exemplified styryl compound Nos. (1)-7, (1)-9, (1)-13, (1)-16, and (1)-20 as the charge transport material and the afore-exemplified monomers (2), (7), (13), (15), and (18), respectively, as the acrylic monomer for protection layer, and evaluated similarly.

Results are shown in Table 2.

EXAMPLE 8

A conductive layer and an undercoat layer were provided on an aluminum cylinder in the same manner as in Example 2.

Dispersed for 20 hours by the sand mill apparatus using the glass beads of $\phi$1 mm were 4 parts of disazo pigment represented by the below formula, 2 parts of polyvinyl benzal (rate of benzalization: 80%, weight average molecular weight: 11,000), and 30 parts of cyclohexanone.

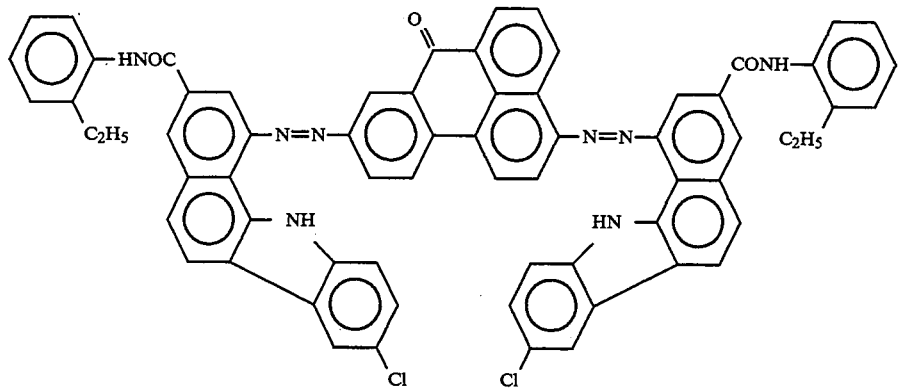

Then, a dispersion liquid for charge generation layer was prepared by adding 60 parts of methylethyl ketone into the above dispersed mixture.

The dispersion liquid was coated by spraying over the above-mentioned undercoat layer, and then dried at 80° C. for fifteen minutes to form a charge generation layer of 0.20 $\mu$m film thickness.

10 parts of the afore-exemplified styryl compound (1)-21 as the charge transport material was then solved together with 10 parts of polycarbonate (weight average molecular weight: 25,000) into a mixed solvent of 20 parts of methylene chloride and 40 parts of chlorobenzene. This solution was coating by dipping on the above undercoat layer, and dried at 120° C. for 60 minutes to form a charge transport layer of 15 $\mu$m film thickness.

An electrophotographic photosensitive member was obtained by forming a protection layer on the charge transport layer in the same manner as in Example 2.

The thus formed electrophotographic photosensitive member was assembled in a laser printer of reversal development type, which repeats 1.5 sec cycle of charge, laser exposure, development, transfer, and cleaning processes. Electrophotographic properties were evaluated at the ordinary temperature under the ordinary pressure, and 10,000 times of image formation were repeated as a durability test.

Results are shown in Table 2.

EXAMPLE 9

Layers up to the photosensitive layer were formed in the same manner as in Example 8. Then a mixed liquid of 20 parts of the afore-exemplified acrylic monomer (21), 30 parts of methanol, 50 parts of methoxypropanol, and 2 parts of 2-methylthioxanthone as a photoinitiator was coated by dipping on the photosensitive layer, and dried at 60° C. for an hour. After the drying, it was subjected to photo-setting by the high pressure mercury vapor lamp in the same manner as in Example 1 to obtain a protection layer. The film thickness of the protection layer was 0.8 μm. The resulting photosensitive member was evaluated in the same way as in Example 8.

Comparative Example 1

A photosensitive member was made in the same manner as in Example 2 except that no protection layer was formed, and evaluated similarly. Results are shown in Table 2. As shown in Table 2, the photosensitive member of Comparative example 1 showed good initial electrophotographic properties, but had a difficulty in formation of good image after the durability test of 300 sheets because of abrasion of the charge generation layer surface.

Comparative Example 2

A photosensitive member was made in the same manner as in Example 2 except that the integrating resin in the protection layer was a polycarbonate resin. Using the photosensitive member, evaluation was conducted similar to Example 2.

Results are shown in Table 2.

Comparative Examples 3–5

Photosensitive members were made in the same manner as in Example 2 except that the afore-exemplified styryl compound Nos. (1)-26, (1)-28, and (1)-38 were used as the charge transport material, and evaluated similarly.

Results are shown in Table 2.

TABLE 2

| | Electrophotographic properties | | Image | | | Abrasion amount |
|---|---|---|---|---|---|---|
| | Dark part potential (V) | Sensitivity (lux-sec) | Residual potential (V) | Initial condition | Condition after 10,000 sheets | after durability test (μm) |
| Example 2 | 850 | 2.0 | 15 | Good | Good | 0.8 |
| Example 3 | 850 | 2.0 | 20 | Good | Good | 1.5 |
| Example 4 | 850 | 1.9 | 20 | Good | Good | 1.8 |
| Example 5 | 850 | 2.0 | 15 | Good | Good | 1.3 |
| Example 6 | 860 | 1.9 | 20 | Good | Good | 1.5 |
| Example 7 | 850 | 2.3 | 15 | Good | Good | 1.8 |
| Example 8 | −850 | 1.8 (μJ/cm$^2$) | −25 | Good | Good | 0.9 |
| Example 9 | −850 | 1.7 (μJ/cm$^2$) | −30 | Good | Good | 0.7 |
| Example 10 | 850 | 2.0 | 25 | Good | Good | 0.8 |
| Example 11 | 840 | 1.9 | 20 | Good | Good | 0.8 |
| Example 12 | 850 | 1.8 | 15 | Good | Good | 0.7 |
| Comparative example 1 | 850 | 2.1 | 10 | Good | Image defect after 300 sheets | — |
| Comparative example 2 | 840 | 4.2 | 110 | Black dot occurrence | Image defect after 7,000 sheets | 3.1 |
| Comparative example 3 | 840 | 2.0 | 20 | Image defect due to cracks | Image defect due to cracks | 0.8 |
| Comparative example 4 | 850 | 1.9 | 15 | Image defect due to cracks | Image defect due to cracks | 0.8 |
| Comparative example 5 | 840 | 1.9 | 20 | Image defect due to cracks | Image defect due to cracks | 0.7 |

Results are shown in Table 2.

EXAMPLES 10–12

Photosensitive members were made in the same manner as in Example 2 except that their charge transport materials were prepared from the following compositions, and evaluated similarly.

Example 10: Exemplified styryl compound No. (1)-15 50 parts, No. (1)-29 50 parts Example 11: Exemplified styryl compound No. (1)-3 20 parts, No. (1)-30 80 parts Example 12: Exemplified styryl compound No. (1)-21 60 parts, No. (1)-31 40 parts Results are shown in Table 2.

EXAMPLE 13

Photosensitive members were made in the-same manner as in Example 1 except that triarylamine compounds as listed in Table 3 were used as the charge transport material, and evaluated similarly.

Results are shown in Table 3.

TABLE 3

| Exemplified triarylamine compound No. | Melting Pt. of triaylamine compound (°C.) | Crack appearance on photosensitive member |
|---|---|---|
| (2)-5 | 82~84 | ○ |
| (2)-8 | 96~97 | ○ |
| (2)-9 | 96~98 | ○ |

TABLE 3-continued

| Exemplified triarylamine compound No. | Melting Pt. of triaylamine compound (°C.) | Crack appearance on photosensitive member |
|---|---|---|
| (2)-11 | 100~101 | ○ |
| (2)-15 | 105~106.5 | ○ |
| (2)-20 | 116~117 | ○ |
| (2)-27 | 125.5~126.5 | ○ |
| (2)-33 | 129~130 | ○ |
| (2)-39 | 141~143 | ○ |
| (2)-43 | 144.5~145.5 | ○ |
| (2)-45 | 146.5~148.0 | ○ |
| (2)-47 | 152.5~153.5 | Δ |
| (2)-49 | 156~157.5 | Δ |
| (2)-53 | 168.0~169.0 | Δ |
| (2)-54 | 172.0~174.0 | x |
| (2)-58 | 180~181 | x |
| (2)-60 | 182.5~183.5 | x |
| (2)-67 | 194.5~196.0 | x |
| (2)-69 | 211.0~212.5 | x |

As shown in Table 1, as the melting point of charge transport material decreases, the appearance of crack also decreases to become null at and below 150° C.

EXAMPLE 14

A photosensitive member was made in the same manner as in Example 2 except that the afore-exemplified triarylamine compound No. (2)-18 was used as the charge transport material, and evaluated similarly.

Results are shown in Table 4. As shown in Table 4, the photosensitive member of Example 14 showed the sensitivity and the residual potential equivalent to those of a photosensitive member of Comparative example 6 without a protection layer, while keeping stable images without unevenness and black dot. Further, the photosensitive member of the present invention provided the stable images without occurrence of image degradation such as black band, which is an image defect of black belt.

EXAMPLES 15–19

Photosensitive members were prepared in the same manner as in Example 2 except that used were the afore-exemplified triarylamine compound Nos. (2)-4, (2)-17, (2)-19, (2)-30, and (2)-38 as the charge transport material, and the afore-exemplified monomers (2), (7), (13), (15), and (18), respectively, as the acrylic monomer for protection layer, and evaluated similarly.

Results are shown in Table 4.

EXAMPLE 20

A photosensitive member was made in the same manner as in Example 8 except that the thickness of charge generation layer was 0.10 μm and that the afore-exemplified triarylamine compound No. (2)-8, was used as the charge transport material, and evaluated similarly.

Results are shown in Table 4.

EXAMPLE 21

Layers up to the photosensitive layer were formed in the same manner as in Example 20. A photosensitive member was then made in the same manner as in Example 9 except that the exemplified compound No. (20) was used as the acrylic monomer, and evaluated similarly.

Results are shown in Table 4.

EXAMPLES 22–24

Photosensitive members were made in the same manner as in Example 14 except that their charge transport materials were prepared from the following compositions, and evaluated similarly.

Example 22: Exemplified triarylamine compound No. (2)-3 50 parts, No. (2)-50 50 parts Example 23: Exemplified triarylamine compound No. (2)-18 20 parts, No. (2)-53 80 parts Example 24: Exemplified triarylamine compound No. (2)-40 60 parts, No. (2)-57 40 parts Results are shown in Table 4.

Comparative Example 6

A photosensitive member was made in the same manner as in Example 14 except that no protection layer was formed, and evaluated similarly.

Results are shown in Table 4. As shown in Table 4, the photosensitive member of Comparative example 6 showed good initial electrophotographic properties, but had a difficulty in formation of good image after the durability test of 300 sheets because of abrasion of the charge generation layer surface.

Comparative Example 7

A photosensitive member was made in the same manner as in Example 14 except that the integrating resin in the protection layer was a polycarbonate resin. Using the photosensitive member, evaluation was conducted similar to Example 14.

Results are shown in Table 4.

Comparative Example 8–10

Photosensitive members were made in the same manner as in Example 14 except that the afore-exemplified triarylamine compound Nos. (2)-53, (2)-59, and (2)-72 were used as the charge transport material, and evaluated similarly.

Results are shown in Table 4.

TABLE 2

| | Electrophotographic properties | | Image | | | Abrasion amount |
|---|---|---|---|---|---|---|
| | Dark part potential (V) | Sensitivity (lux-sec) | Residual potential (V) | Initial condition | Condition after 10,000 sheets | after durability test (μm) |
| Example 2 | 850 | 2.0 | 15 | Good | Good | 0.8 |
| Example 3 | 850 | 2.0 | 20 | Good | Good | 1.5 |
| Example 4 | 850 | 1.9 | 20 | Good | Good | 1.8 |
| Example 5 | 850 | 2.0 | 15 | Good | Good | 1.3 |
| Example 6 | 860 | 1.9 | 20 | Good | Good | 1.5 |
| Example 7 | 850 | 2.3 | 15 | Good | Good | 1.8 |
| Example 8 | −850 | 1.8 (μJ/cm$^2$) | −25 | Good | Good | 0.9 |
| Example 9 | −850 | 1.7 (μJ/cm$^2$) | −30 | Good | Good | 0.7 |
| Example 10 | 850 | 2.0 | 25 | Good | Good | 0.8 |
| Example 11 | 840 | 1.9 | 20 | Good | Good | 0.8 |
| Example 12 | 850 | 1.8 | 15 | Good | Good | 0.7 |

TABLE 2-continued

| | Electrophotographic properties | | Image | | | Abrasion amount |
|---|---|---|---|---|---|---|
| | Dark part potential (V) | Sensitivity (lux-sec) | Residual potential (V) | Initial condition | Condition after 10,000 sheets | after durability test (μm) |
| Comparative example 1 | 850 | 2.1 | 10 | Good | Image defect after 300 sheets | — |
| Comparative example 2 | 840 | 4.2 | 110 | Black dot occurrence | Image defect after 7,000 sheets | 3.1 |
| Comparative example 3 | 840 | 2.0 | 20 | Image defect due to cracks | Image defect due to cracks | 0.8 |
| Comparative example 4 | 850 | 1.9 | 15 | Image defect due to cracks | Image defect due to cracks | 0.8 |
| Comparative example 5 | 840 | 1.9 | 20 | Image defect due to cracks | Image defect due to cracks | 0.7 |

EXAMPLE 25

Photosensitive members were made in the same manner as in Example 1 except that hydrazone compounds as listed in Table 5 were used as the charge transport material, and evaluated similarly.

Results are shown Table 5.

TABLE 5

| Exemplified hydrazone compound No. | Melting Pt. of hydrazone compound (°C.) | Crack appearance on photosensitive member |
|---|---|---|
| (3)-3 | 81~82 | ○ |
| (3)-7 | 106~107 | ○ |
| (3)-9 | 110~111 | ○ |
| (3)-14 | 124~124.5 | ○ |
| (3)-18 | 134~135 | ○ |
| (3)-22 | 144~145 | ○ |
| (3)-24 | 148~149 | ○ |
| (3)-26 | 153~154 | ○ |
| (3)-27 | 154~155 | ○ |
| (3)-29 | 159~160 | Δ |
| (3)-32 | 167~168 | Δ |
| (3)-35 | 173~174 | x |
| (3)-40 | 175~176.5 | x |
| (3)-43 | 186~187 | x |
| (3)-45 | 197~198 | x |

As shown in Table 5, as the melting point of charge transport material decreases, the appearance of crack also decreases to become null at and below 155° C.

EXAMPLE 26

A photosensitive member was made in the same manner as in Example 2 except that the afore-exemplified hydrazone compound No. (3)-17 was used as the charge transport material, and evaluated similarly.

Results are shown in Table 6. As shown in Table 6, the photosensitive member of Example 26 showed the sensitivity and the residual potential equivalent to those of a photosensitive member of Comparative example 11 without a protection layer, while keeping stable images without unevenness and black dot. Further, the photosensitive member of the present invention provided the stable images without occurrence of image degradation such as black band, which is an image defect of black belt.

EXAMPLES 27–31

Photosensitive members were prepared in the same manner as in Example 2 except that used were the afore-exemplified hydrazone compound Nos. (3)-4, (3)-13, (3)-15, (3)-18, and (3)-27 as the charge transport material, and the afore-exemplified monomers (2), (7), (13), (15), and (18), respectively, as the acrylic monomer for protection layer, and evaluated similarly.

Results are shown in Table 6.

EXAMPLE 32

A photosensitive member was made in the same manner as in Example 8 except that the thickness of charge generation layer was 0.10 μm and that the afore-exemplified hydrazone compound No. (3)-19 was used as the charge transport material, and evaluated similarly.

Results are shown in Table 6.

EXAMPLE 33

Layers up to the photosensitive layer were formed in the same manner as in Example 32. A photosensitive member was then made in the same manner as in Example 9 except that the exemplified compound No. (20) was used as the acrylic monomer, and evaluated similarly.

Results are shown in Table 6.

EXAMPLES 34–36

Photosensitive members were made in the same manner as in Example 26 except that their charge transport materials were prepared from the following compositions, and evaluated similarly.

Example 34: Exemplified hydrazone compound No. (3)-7 50 parts, No. (3)-29 50 parts Example 35: Exemplified hydrazone compound No. (3)-4 20 parts, No. (3)-28 80 parts Example 36: Exemplified hydrazone compound No. (3)-11 60 parts, No. (3)-31 40 parts Results are shown in Table 6.

Comparative Example 11

A photosensitive member was made in the same manner as in Example 26 except that no protection layer was formed, and evaluated similarly.

Results are shown in Table 6. As shown in Table 6, the photosensitive member of Comparative example 11 showed good initial electrophotographic properties, but had a difficulty in formation of good image after the durability test of 300 sheets because of abrasion of the charge generation layer surface.

Comparative Example 12

A photosensitive member was made in the same manner as in Example 26 except that the integrating resin in the protection layer was a polycarbonate resin. Using the photosensitive member, evaluation was conducted similar to Example 26.

Results are shown in Table 6.

Comparative Examples 13–15

Photosensitive members were made in the same manner as in Example 26 except that the afore-exemplified hydrazone compound Nos. (3)-32, (3)-35, and (3)-40 were used as the charge transport material, and evaluated similarly.

Results are shown in Table 6.

TABLE 6

| | Electrophotographic properties | | Image | | | Abrasion amount |
|---|---|---|---|---|---|---|
| | Dark part potential (V) | Sensitivity (lux-sec) | Residual potential (V) | Initial condition | Condition after 10,000 sheets | after durability test (μm) |
| Example 26 | 850 | 2.2 | 25 | Good | Good | 0.8 |
| Example 27 | 840 | 2.1 | 35 | Good | Good | 1.5 |
| Example 28 | 850 | 2.2 | 35 | Good | Good | 1.8 |
| Example 29 | 835 | 2.3 | 30 | Good | Good | 1.3 |
| Example 30 | 860 | 2.4 | 30 | Good | Good | 1.5 |
| Example 31 | 850 | 2.3 | 15 | Good | Good | 1.8 |
| Example 32 | −850 | 1.8 (μJ/cm$^2$) | −25 | Good | Good | 0.9 |
| Example 33 | −850 | 2.0 (μJ/cm$^2$) | −60 | Good | Good | 0.4 |
| Example 34 | 840 | 2.3 | 25 | Good | Good | 0.8 |
| Example 35 | 840 | 2.2 | 30 | Good | Good | 0.8 |
| Example 36 | 850 | 2.4 | 30 | Good | Good | 0.7 |
| Comparative example 11 | 820 | 2.1 | 10 | Good | Image defect after 300 sheets | — |
| Comparative example 12 | 690 | 3.8 | 90 | Black dot occurrence | Image defect after 7,000 sheets | 3.1 |
| Comparative example 13 | 840 | 2.2 | 30 | Image defect due to cracks | Image defect due to cracks | 0.8 |
| Comparative example 14 | 830 | 2.3 | 25 | Image defect due to cracks | Image defect due to cracks | 0.8 |
| Comparative example 15 | 840 | 2.4 | 25 | Image defect due to cracks | Image defect due to cracks | 0.7 |

As seen above, the present invention may provide an electrophotographic photosensitive member, in which a photosensitive member is given without crack appearance a protection layer having high hardness and excellent durability, and which may supply high quality images without unevenness or defects of image from beginning to after substantial repetition use.

Further in the present invention, conductive microparticles may be dispersed in the protection layer. The excellent dispersibility and dispersion stability thereof contribute to stable supply of higher quality image with high transparency and durability, but without residual potential.

What is claimed is:

1. An electrophotographic photosensitive member comprising a conductive support, a photosensitive layer and a protective layer, said protective layer containing resin formed by photosetting a photoinitiator type acrylic monomer, and said photosensitive layer containing at least one compound selected from the group consisting of (A), (B) and (C) below:

(A) styryl compounds having a structure expressed by the following formula (1) and a melting point not higher than 135° C.;

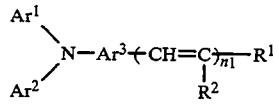

(1)

wherein $Ar^1$ and $Ar^2$ are aromatic ring groups, $Ar^3$ is a bivalent aromatic ring group or a bivalent heterocyclic group, $R^1$ is an alkyl group or an aromatic ring group, $R^2$ is a hydrogen atom, an alkyl group or an aromatic ring group, and $n_1$ is 1 or 2, and $R^1$ and $R^2$ may be joined to form a ring when $n_1=1$:

(B) triarylamine compounds having a structure expressed by the following formula (2) and a melting point not higher than 150° C.;

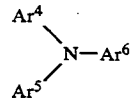

(2)

wherein $Ar^4$, $Ar^5$ and $Ar^6$ are each an aromatic ring group or a heterocyclic group:

(c) hydrazone compounds having a structure expressed by the following formula (3) and a melting point not higher than 155° C.;

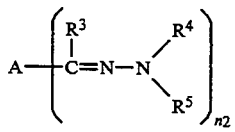

(3)

wherein $R^3$ Is a hydrogen atom or an alkyl group, $R^4$ and $R^5$ are alkyl groups, aralkyl groups or aromatic ring groups, $n_2$ is 1 or 2, A is an aromatic ring group, a heterocyclic group or —CH=C($R^6$)$R^7$ ($R^6$ and $R^7$ are hydrogen atoms, aromatic ring groups or heterocyclic groups provided that $R^6$ and $R^7$ are not both hydrogen atoms at the same time).

2. An electrophotographic photosensitive member according to claim 1, wherein said compound is (A).

3. An electrophotographic photosensitive member according to claim 1, wherein said compound is (B).

4. An electrophotographic photosensitive member according to claim 1, wherein said compound is (C).

5. An electrophotographic photosensitive member according to claim 1, wherein said photoinitial type acrylic monomer has three or more functional groups per molecule.

6. An electrophotographic photosensitive member according to claim 1, wherein said photoinitial type acrylic monomer has functional groups not less than 0.004 mol/g.

7. An electrophotographic photosensitive member according to claim 1, wherein said protective layer contains conductive particles.

8. An electrophotographic photosensitive member according to claim 7, wherein said conductive particles are metal oxide particles.

9. An electrophotographic photosensitive member according to claim 1, wherein said protective layer contains a coupling agent and/or an anti-oxidizing agent.

10. An electrophotographic photosensitive member according to claim 1, wherein said photosensitive layer comprises a charge generating layer and a charge transporting layer.

11. An electrophotographic photosensitive member according to claim 10, wherein said electrophotographic photosensitive member comprises a conductive support, a charge generating layer and a charge transporting layer in this order.

12. An electrophotographic photosensitive member according to claim 10, wherein said electrophotographic photosensitive member comprises a conductive support, a charge transporting layer and a charge generating layer in this order.

13. An electrophotographic photosensitive member according to claim 1, wherein said photosensitive layer is a single layer.

14. An electrophotographic photosensitive member according to claim 1, wherein said electrophotographic photosensitive member has an underlying layer between said conductive support and said photosensitive layer.

15. An electrophotographic apparatus comprising an electrophotographic photosensitive member, an electrostatic latent image forming means, a means for developing an electrostatic latent image formed by said electrostatic latent image forming means, and a means for transferring a developed image to a transfer material, said electrophotographic photosensitive member comprising a conductive support, a photosensitive layer and a protective layer, said protective layer containing resin formed by photosetting a photoinitial type acrylic monomer, and said photosensitive layer containing at least one compound selected from the group consisting of (A), (B) and (C) below:

(A) styryl compounds having a structure expressed by the following formula (1) and a melting point not higher than 135° C.;

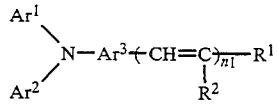

(1)

wherein $Ar^1$ and $Ar^2$ are aromatic ring groups, $Ar^3$ is a bivalent aromatic ring group or a bivalent heterocyclic group, $R^1$ is an alkyl group or an aromatic ring group, $R^2$ is a hydrogen atom, an alkyl group or an aromatic ring group, and $n_1$ is 1 or 2, $R^1$ and $R^2$ may be joined to form a ring when $n_1=1$:

(B) triarylamine compounds having a structure expressed by the following formula (2) and a melting point not higher than 150° C.;

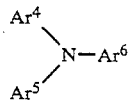

(2)

wherein $Ar^4$, $Ar^5$ and $Ar^6$ are each an aromatic ring group or a heterocyclic group:

(c) hydrazone compounds having a structure expressed by the following formula (3) and a melting point not higher than 155° C.;

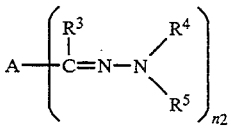

(3)

wherein $R^3$ is a hydrogen atom or an alkyl group, $R^4$ and $R^5$ are alkyl groups, aralkyl groups or aromatic ring groups, $n_2$ is 1 or 2, A is an aromatic ring group, a heterocyclic group or $-CH=C(R^6)R^7$ ($R^6$ and $R^7$ are hydrogen atoms, aromatic ring groups or heterocyclic groups, provided that $R^6$ and $R^7$ are not both hydrogen atoms at the same time).

16. An electrophotographic apparatus according to claim 15, wherein said compound is (A).

17. An electrophotographic apparatus according to claim 15, wherein said compound is (B).

18. An electrophotographic apparatus according to claim 15, wherein said compound is (C).

19. A device unit comprising an electrophotographic photosensitive member, and at least one means selected from the group consisting of charging means, developing means and cleaning means, said electrophotographic photosensitive member comprising a conductive support, a photosensitive layer and a protective layer, said protective layer containing resin formed by photosetting a photoinitial type acrylic monomer, and said photosensitive layer containing at least one compound selected from the group consisting of (A), (B) and (C) below;

(A) styryl compounds having a structure expressed by the following formula (1) and a melting point not higher than 135° C.;

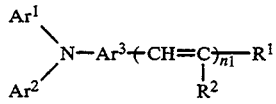

(1)

wherein $Ar^1$ and $Ar^2$ are aromatic ring groups, $Ar^3$ is a bivalent aromatic ring group or a bivalent heterocyclic group, $R^1$ is an alkyl group or an aromatic ring group, $R^2$ is a hydrogen atom, an alkyl group or an aromatic ring group, and $n_1$ is 1 or 2, $R^1$ and $R^2$ may be joined to form a ring when $n_1=1$:

(B) triarylamine compounds having a structure expressed by the following formula (2) and a melting point not higher than 150° C.;

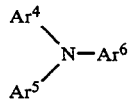

(2)

wherein $Ar^4$, $Ar^5$ and $Ar^6$ are each an aromatic ring group or a heterocyclic group:

(C) hydrazone compounds having a structure expressed by the following formula (3) and a melting point not higher than 155° C.;

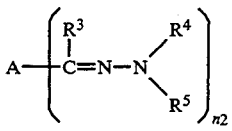

(3)

wherein $R^3$ is a hydrogen atom or an alkyl group, $R^4$ and $R^5$ are alkyl groups, aralkyl groups or aromatic ring groups, $n_2$ is 1 or 2, A is an aromatic ring group, a heterocyclic group or $—CH=C(R^6)R^7$ ($R^6$ and $R^7$ are hydrogen atoms, aromatic ring groups or heterocyclic groups, provided that $R^6$ and $R^7$ are not both hydrogen atoms at the same time), said unit supporting said electrophotographic photosensitive member and said at least one means selected from the group consisting of charging means, developing means and cleaning means together, and being attached to an apparatus body in a detachable manner.

20. A device unit according to claim 19, wherein said compound is (A).

21. A device unit according to claim 19, wherein said compound is (B).

22. A device unit according to claim 19, wherein said compound is (C).

23. A facsimile machine comprising an electrophotographic apparatus and means for receiving image information from a remote terminal, said electrophotographic apparatus having an electrophotographic photosensitive member, said electrophotographic photosensitive member comprising a conductive support, a photosensitive layer and a protective layer, said protective layer containing resin formed by photosetting a photoinitiator type acrylic monomer, and said photosensitive layer containing at least one compound selected from the group consisting of (A), (B) and (C) below;

(A) styryl compounds having a structure expressed by the following formula (1) and a melting point not higher than 135° C.;

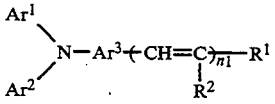

(1)

wherein $Ar^1$ and $Ar^2$ are aromatic ring groups, $Ar^3$ is a bivalent aromatic ring group or a bivalent heterocyclic group, $R^1$ is an alkyl group or an aromatic ring group, $R^2$ is a hydrogen atom, an alkyl group or an aromatic ring group, and $n_1$ is 1 or 2, $R^1$ and $R^2$ may be joined to form a ring when $n_1=1$:

(B) triarylamine compounds having a structure expressed by the following formula (2) and a melting point not higher than 150° C.;

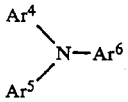

(2)

wherein $Ar^4$, $Ar^5$ and $Ar^6$ are each an aromatic ring group or a heterocyclic group:

(C) hydrazone compounds having a structure expressed by the following formula (3) and a melting point not higher than 155° C.;

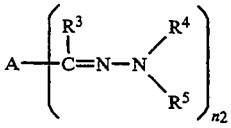

(3)

wherein $R^3$ is a hydrogen atom or an alkyl group, $R^4$ and $R^5$ are alkyl groups, aralkyl groups or aromatic ring groups, $n_2$ is 1 or 2, A is an aromatic ring group, a heterocyclic group or $—CH=C(R^6)R^7$ ($R^6$ and $R^7$ are hydrogen atoms, aromatic ring groups or heterocyclic groups, provided that $R^6$ and $R^7$ are not simultaneously both hydrogen atoms.

24. A facsimile unit according to claim 23, wherein said compound is (A).

25. A facsimile unit according to claim 23, wherein said compound is (B).

26. A facsimile unit according to claim 23, wherein said compound is (C).

* * * * *

UNITED STATES PATENT AND TRADEMARK OFFICE

CERTIFICATE OF CORRECTION

PATENT NO. : 5,422,210

DATED : June 6, 1995

INVENTOR(S) : Akio Maruyama, et al.

It is certified that error appears in the above-indentified patent and that said Letters Patent is hereby corrected as shown below:

On the title page, item:

[75] Inventors

"Toshiro Kikuchi" should read --Toshihiro Kikuchi--.

[30] Foreign Application Priority Data

"Mar. 18, 1991 [JP] Japan ..... 4-062306" should read --Mar. 18, 1992 [JP] Japan ..... 4-062306--.

[57] ABSTRACT

Line 1, "A" should read --An--; and

Line 23, "group" should read --group;--.(2nd. Occur.).

COLUMN 4

Line 12, "is" should read --as--.

COLUMN 8

Line 28, "R" = isopropyl" should read --R"'= isopropyl--; and

Line 67, "in" should read --a--.

COLUMN 9

Line 2, "acattered" should read --scattered--; and

Line 18, "agent" should read --agents--.

UNITED STATES PATENT AND TRADEMARK OFFICE

CERTIFICATE OF CORRECTION

PATENT NO. : 5,422,210

DATED : June 6, 1995

INVENTOR(S) : Akio Maruyama, et al.

It is certified that error appears in the above-indentified patent and that said Letters Patent is hereby corrected as shown below:

COLUMN 10

Line 67, "naphtoxy;" should read --naphthoxy;--.

COLUMN 11

Line 18, "naphtoxy;" should read --naphthoxy;--.

COLUMN 64

Line 58, "is" should read --are--.

COLUMN 66

Line 59, "A," should read --Δ,--; and

Line 62, "A" should read --Δ--.

COLUMN 72

Table 2 "

TABLE 2

| | Electrophotographic properties | | Image | | | Abrasion amount |
|---|---|---|---|---|---|---|
| | Dark part potential (V) | Sensitivity (lux-sec) | Residual potential (V) | Initial condition | Condition after 10,000 sheets | after durability test (μm) |
| Example 2 | 850 | 2.0 | 15 | Good | Good | 0.8 |
| Example 3 | 850 | 2.0 | 20 | Good | Good | 1.5 |
| Example 4 | 850 | 1.9 | 20 | Good | Good | 1.6 |
| Example 5 | 850 | 2.0 | 15 | Good | Good | 1.3 |
| Example 6 | 840 | 1.9 | 20 | Good | Good | 1.5 |
| Example 7 | 850 | 2.3 | 15 | Good | Good | 1.8 |
| Example 8 | −850 | 1.8 (μJ/cm²) | −25 | Good | Good | 0.9 |
| Example 9 | −850 | 1.7 (μJ/cm²) | −30 | Good | Good | 0.7 |
| Example 10 | 850 | 2.0 | 25 | Good | Good | 0.8 |
| Example 11 | 840 | 1.9 | 20 | Good | Good | 0.8 |
| Example 12 | 850 | 1.8 | 15 | Good | Good | 0.7 |

UNITED STATES PATENT AND TRADEMARK OFFICE

CERTIFICATE OF CORRECTION

PATENT NO. : 5,422,210

DATED : June 6, 1995

INVENTOR(S) : Akio Maruyama, et al.

It is certified that error appears in the above-indentified patent and that said Letters Patent is hereby corrected as shown below:

COLUMN 72, Cont'd.

should read --

TABLE 4

| | Electrophotographic properties | | Image | | | Abrasion amount after durability test (μm) |
|---|---|---|---|---|---|---|
| | Dark part potential (V) | Sensitivity (lux·sec) | Residual potential (V) | Initial condition | Condition after 10,000 sheets | |
| Example 14 | 950 | 1.9 | 20 | Good | Good | 0.8 |
| Example 15 | 850 | 1.8 | 15 | Good | Good | 1.5 |
| Example 16 | 850 | 1.9 | 15 | Good | Good | 1.8 |
| Example 17 | 950 | 1.8 | 20 | Good | Good | 1.3 |
| Example 18 | 850 | 1.9 | 20 | Good | Good | 1.5 |
| Example 19 | 850 | 1.9 | 15 | Good | Good | 1.8 |
| Example 20 | -850 | 2.1(μJ/cm²) | -25 | Good | Good | 0.9 |
| Example 21 | -850 | 2.0(μJ/cm²) | -30 | Good | Good | 0.4 |
| Example 22 | 840 | 1.8 | 15 | Good | Good | 0.8 |
| Example 23 | 850 | 1.9 | 15 | Good | Good | 0.8 |
| Example 24 | 850 | 1.7 | 20 | Good | Good | 0.7 |
| Comparative example 6 | 850 | 1.7 | 10 | Good | Image defect after 300 sheets | - |
| Comparative example 7 | 850 | 4.0 | 100 | Black dot occurrence | Image defect after 7,000 sheets | 3.1 |
| Comparative example 8 | 840 | 1.9 | 40 | Image defect due to cracks | Image defect due to cracks | 0.8 |
| Comparative example 9 | 840 | 2.1 | 30 | Image defect due to cracks | Image defect due to cracks | 0.8 |
| Comparative example 10 | 840 | 2.0 | 30 | Image defect due to cracks | Image defect due to cracks | 0.7 |

UNITED STATES PATENT AND TRADEMARK OFFICE

CERTIFICATE OF CORRECTION

PATENT NO. : 5,422,210

DATED : June 6, 1995

INVENTOR(S) : Akio Maruyama, et al.

It is certified that error appears in the above-indentified patent and that said Letters Patent is hereby corrected as shown below:

COLUMN 73

Table 2 - Continued should be deleted.

COLUMN 75

Line 62, "photoinitiator" should read --photoinitiated--.

COLUMN 76

Line 53, "(c)" should read --(C)--; and

Line 64, "Is" should read --is--.

COLUMN 77

Line 1, "groups" should read --groups,--;

Line 10, "photoinitial" should read --photoinitiated--;

Line 15, "photoinitial" should read --photoinitiated--; and

Line 61, "tial" should read --tiated--.

COLUMN 78

Line 26, "(c)" should read --(C)--;

Line 61, "tial" should read --tiated--; and

Line 64, "low;" should read --low:--.

UNITED STATES PATENT AND TRADEMARK OFFICE

CERTIFICATE OF CORRECTION

PATENT NO. : 5,422,210

DATED : June 6, 1995

INVENTOR(S) : Akio Maruyama, et al.

It is certified that error appears in the above-indentified patent and that said Letters Patent is hereby corrected as shown below:

COLUMN 80

Line 5, "tiator" should read --tiated--;

Line 8, "below;" should read --below:--; and

Line 52, "atoms." should read --atoms).--.

Signed and Sealed this

Twenty-eighth Day of November 1995

*Attest:*

Bruce Lehman

BRUCE LEHMAN

*Attesting Officer*

*Commissioner of Patents and Trademarks*